US006333985B1

(12) United States Patent
Ueda et al.

(10) Patent No.: US 6,333,985 B1
(45) Date of Patent: Dec. 25, 2001

(54) METHOD FOR SELECTING SUITABLE HAIR-STYLE AND IMAGE-MAP FOR HAIR-STYLE

(75) Inventors: Mieko Ueda; Yumiko Ishibiki; Kyoko Fukuzawa; Naoko Matsumoto; Ikumi Tokunaga, all of Tokyo (JP)

(73) Assignee: Shiseido Co., Ltd., Tokyo (JP)

( * ) Notice: Subject to any disclaimer, the term of this patent is extended or adjusted under 35 U.S.C. 154(b) by 0 days.

(21) Appl. No.: 09/132,326

(22) Filed: Aug. 11, 1998

(30) Foreign Application Priority Data

Aug. 12, 1997 (JP) ..... 9-230403

(51) Int. Cl.[7] ..... G06K 9/00
(52) U.S. Cl. ..... 382/100; 348/77; 345/435
(58) Field of Search ..... 382/100, 282, 382/284, 286, 294; 348/77, 121; 345/435, 113; 434/371, 377, 395, 399, 428, 429

(56) References Cited

U.S. PATENT DOCUMENTS 2,309,390 1/1943 Grossguth et al. ..... 35/59
4,297,724 * 10/1981 Masuda et al. ..... 358/93
4,434,467 * 2/1984 Scott ..... 364/400
4,539,585 * 9/1985 Spackova et al. ..... 358/93
4,731,743 * 3/1988 Blancato ..... 364/521
4,823,285 * 4/1989 Blancato ..... 364/521
5,174,037 12/1992 Curtin ..... 33/512
6,034,698 * 3/2000 Yasuda ..... 345/435

FOREIGN PATENT DOCUMENTS 2 178 441 A 11/1973 (FR) ..... A45D/44/00
01-154385 A 6/1989 (JP) ..... G11B/27/02

* cited by examiner

*Primary Examiner*—Andrew W. Johns
(74) *Attorney, Agent, or Firm*—Snider & Associates; Ronald R. Snider

(57) ABSTRACT

The present invention provides a method for selecting a suitable hair-style in conformity with individual personalities and face contours, adopting required request of a selector, and at the same time this invention provides an image map for the hair-style where various hair-style are arranged on an axis of co-ordinates according to images. Two lines, namely an inner line which constitutes a boundary line between a face and an inside of hairs and also an outer line which constitutes an outside of the hairs, are developed, and by making the most of these two lines, the selection of the hair-style can be attained in satisfactory manners.

6 Claims, 32 Drawing Sheets

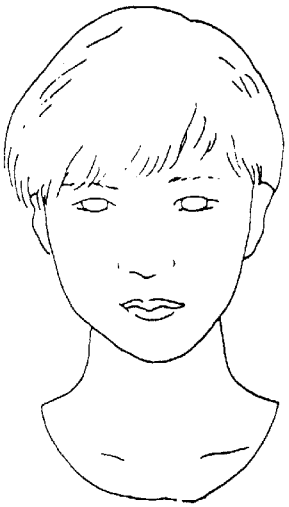
Fig.21A
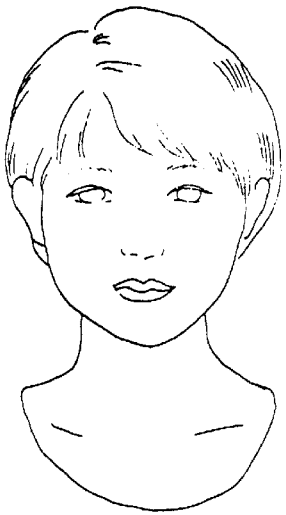
Fig.21B
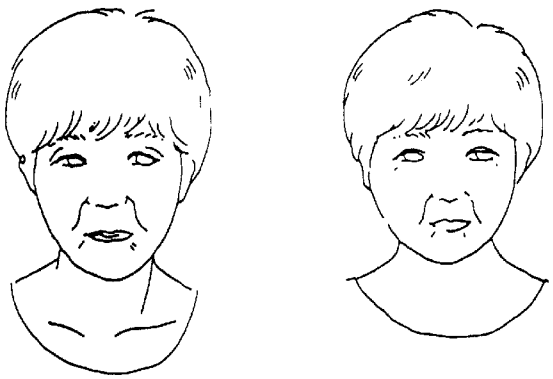
Fig.21C
Fig.21D
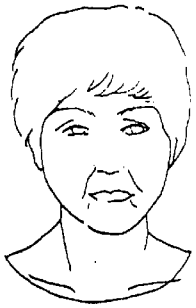
Fig.21E
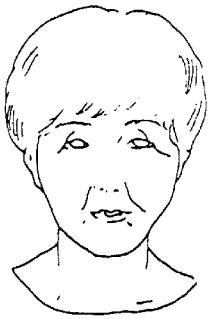
Fig.21F

ANALYSIS 1

ANALYSIS 2

ANALYSIS 3

ANALYSIS 4

METHOD FOR SELECTING SUITABLE HAIR-STYLE AND IMAGE-MAP FOR HAIR-STYLE

RELATED INVENTION

This application claims the priority of Japanese Patent Application No.9-230403 (filed on Aug. 12, 1997) which is expressly incorporated herein by reference in is entirety.

BACKGROUND OF THE INVENTION

In the past, women's selections of their hair-styles have been decided by their individual preferences, images of their faces, fashions, and professional advice issued by a beautician based on her experience, knowledge and senses. However, the selected hair-style may not always be suitable for the woman. When a woman changes her hair-style, she may look as if she were a stranger. Thus, a change in hair-style results in image change. In women's journals and magazines, articles which show suitable hair-styles for different looks are often published, for which some great concern among ladies is paid thereupon. These kinds of published articles, however, mainly offer general information concerning the face model and hair quality, and they do not offer individual or personal information for any particular woman such as features of her own face including her eyes, nose, and mouth. All of these data are of great importance to a choice of the hair-style. Accordingly, it is very difficult for each person to decide in theory whether the selected hair-style is really suitable or not.

SUMMARY OF THE INVENTION

This invention has an object to provide a method for selecting a suitable hair-style after checking whether a selected hair-style is suitable or not and at the same time to provide an image map for a hair-style where various hair-styles are assorted and arranged on an axis of co-ordinates according to general images.

The present invention has another object to provide a method for selecting a suitable hair-style wherein the most suitable hair-style can be decided based on consideration of personality and facial features of each selector, along with adopting her preference and request, and at the same time to provide an image map for a hair-style where it can be easily defined what kind of an image the selected hair-style has.

In order to fulfill the above objects, the present invention has adopted the following means, wherein a contour of the selector's face and its image are defined for the hair-style brought by an inner line which constitutes a boundary line between a face and a hairline and an outer line which constitutes an outside of the hair style, and wherein it is analyzed whether the selected hair-style is suitable or not with respect to form and balance features and also analyzed whether the selected hair-style is suitable to the image.

Analysis for the form and the balance of the hair-style is performed based on five elements; 1. balance between upper and lower parts of the face, 2. Silhouette, 3. Face line, 4. Balancing between head and face, and 5. Total balancing.

Further, analysis for an image of the hair-style is performed based on two elements; 1. An impression on the hair-style and 2. An image gap between face features and a hair-style.

Further, with regard to the analysis for a form of the hair-style and its balance, the analysis is performed based on a comparison of a standard proportion between the hair and the face.

Further, the standard proportion between the hair and the face is devised as follows:

1. The placement of the eyes is in the center of the whole construction.
2. The proportion ratio between distance from the eyes to the top end of a hair style and distance from the eyes to a bottom end of a jaw is 1:1.
3. The proportion ratio between length of a forehead, distance from the bottom of the forehead to a nose tip and distance from the nose tip to the bottom end of the jaw is 1:1:1.
4. The proportion ratio between the length of the forehead and distance from the top of the forehead at the hairline to the top end of the hair style is 1:0.5.
5. The proportion ratio between length and breadth of the face including the head and hair is, 1.5:1.

Further, an image for "light" and "heavy" is prepared on a perpendicular axis up and down, while the image for "curve line" and "straight line" is prepared on a horizontal axis, and thus representative hair-styles in accordance with these expressed images are arranged.

Further, the image for "light" has some features considered to be youthful such as fluffy loose hair ends, bright in color, having hairs on the forehead, to appear dry, and short to medium size.

On the other hand, the image for "heavy" has features associated with to be calm and an adult image such as stable in the hair-ends, dark in color, no hair on the forehead, to appear wet, and medium to long hair length.

The "curve line" depicts a warm and sweet image, with some features of the hair style waved and curled, a rounded line, and abundant soft hair at the sides.

The "straight line" depicts a cool and clean image, with some features of the style straight, an angular line, and having a long and hard silhouette.

BRIEF DESCRIPTIONS OF THE DRAWINGS

All figures of FIG. 17A, FIG. 17B, FIG. 17C and FIG. 17D show a cute and infantile image adorned by curled or rolling hairs.

All figures of FIG. 18A, FIG. 18B, FIG. 18C and FIG. 18D show a sexy image adorned by waved long hairs.

All figures of FIG. 19A, FIG. 19B, FIG. 19C and FIG. 19D show a wild image adorned by short, straight and jagged hair ends.

All figures of FIG. 20A, FIG. 20B, FIG. 20C and FIG. 20D show a fresh and clean image adorned by long hairs with a straight touch.

All figures of FIG. 21A, FIG. 21B, FIG. 21C, FIG. 21D, 21E, and 21F show a natural forehair adorned by short hairs with egg-shape silhouettes.

Figure 22B:
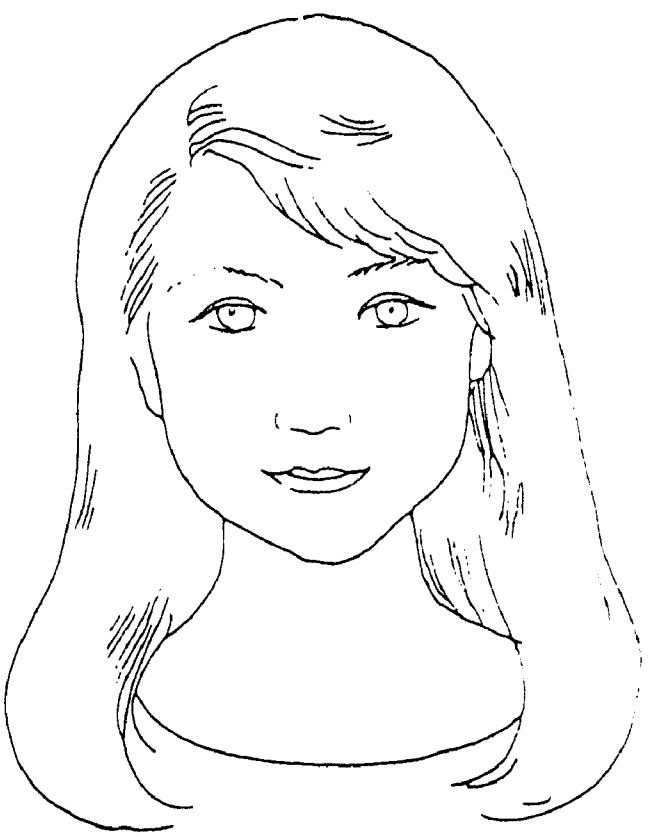
Figure 22A:
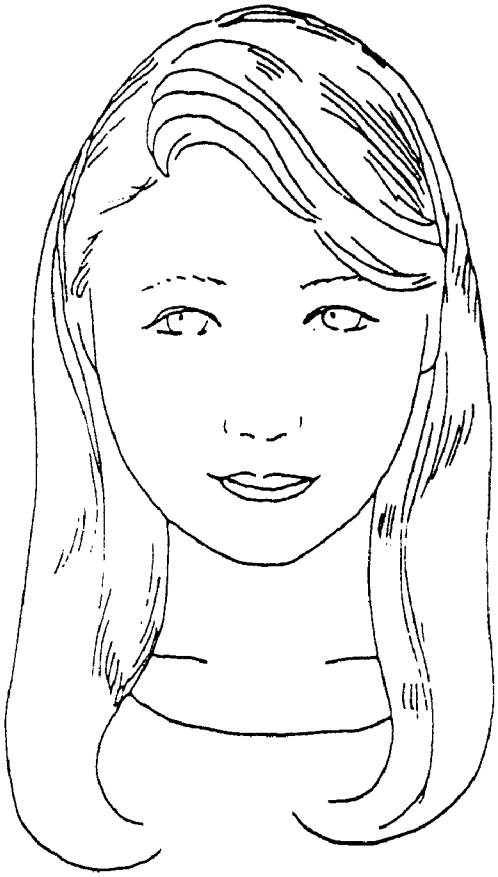

Two figures of FIG. 22A and FIG. 22B show a natural forehair adorned by long hairs.

Figure 23B:
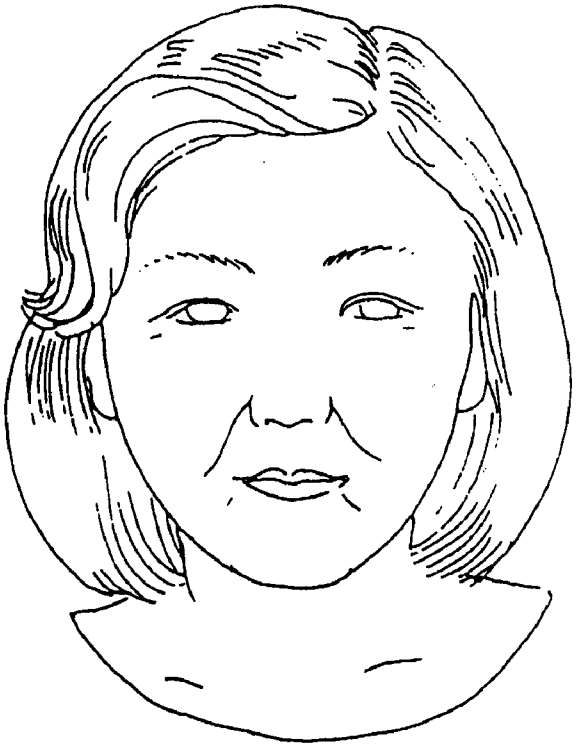
Figure 23A:
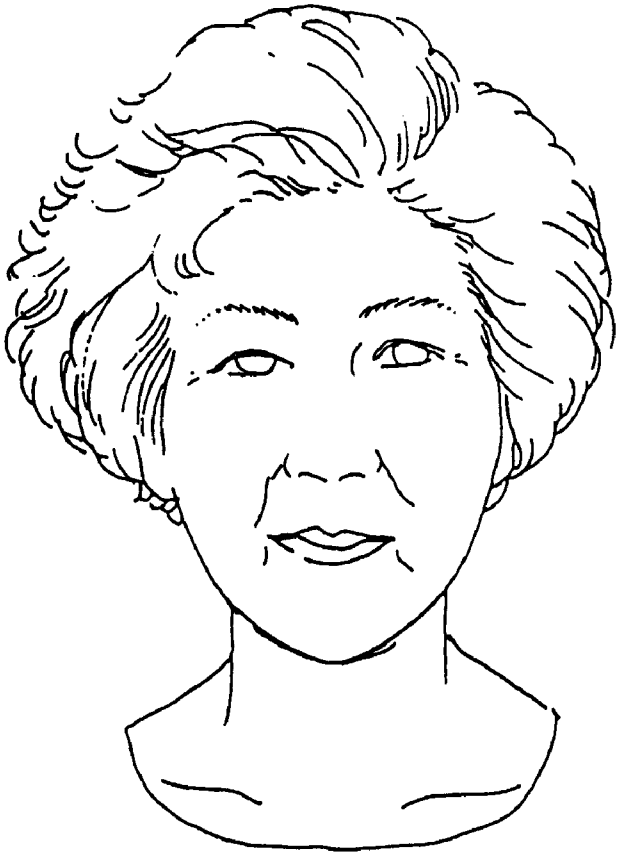

Two figures of FIG. 23A and FIG. 23B show a gentle wave hair in the forehair with short to medium hairs.

Figure 24:
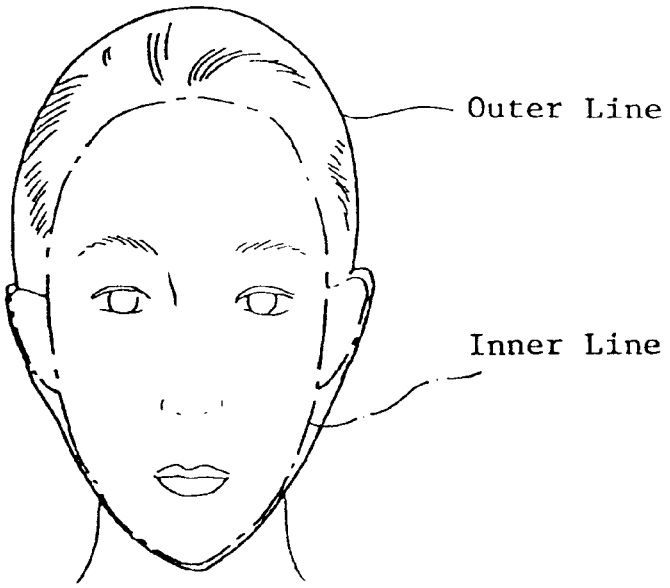

FIG. 24 shows an inner line depicted along a boundary between a face and a hair line.

Figure 25:
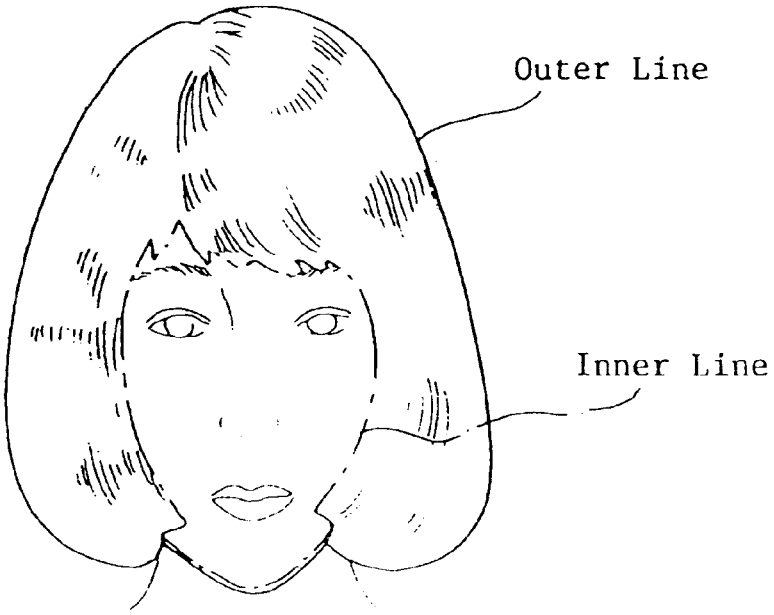

FIG. 25 shows a condition which conceals a forehead with forehairs or bangs.

Figure 26B:
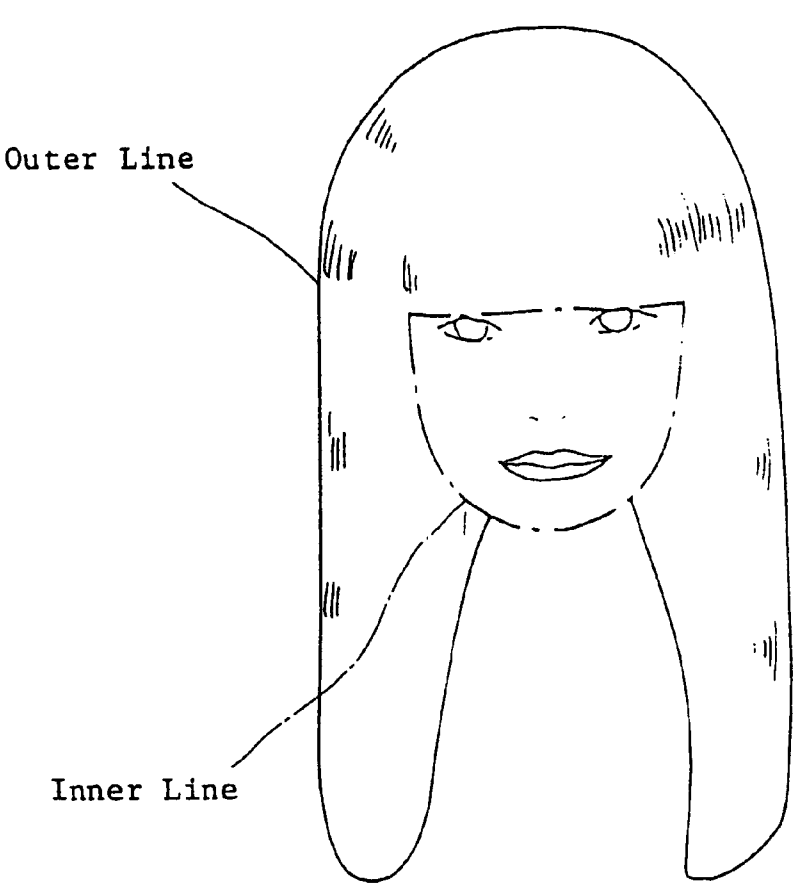
Figure 26A:
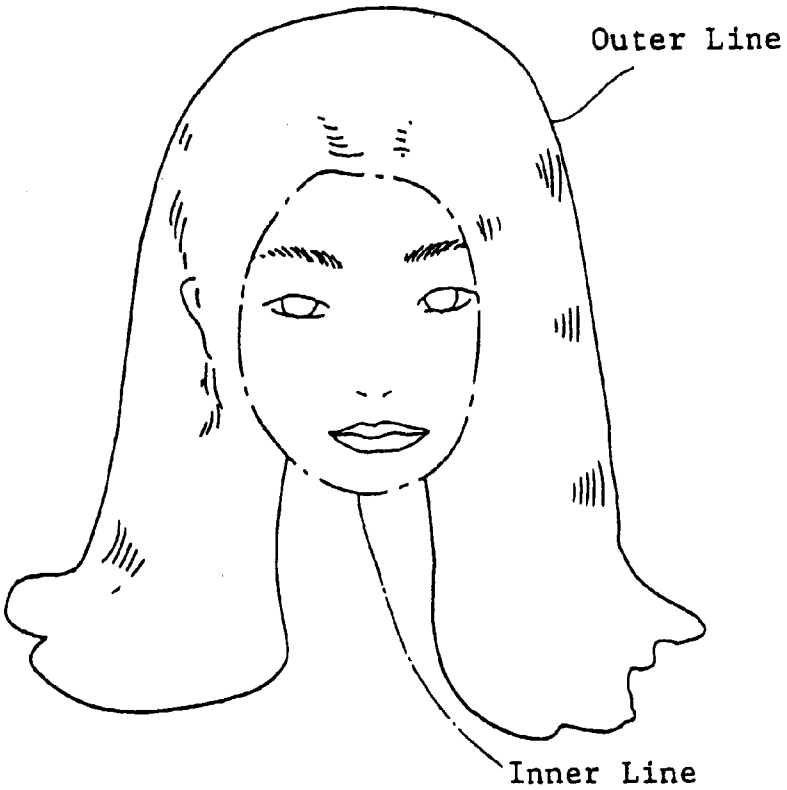

Two figures of FIG. 26A and FIG. 26B compare an inner line with an outer line which is depicted along the out side of the hair style.

Figure 27B:
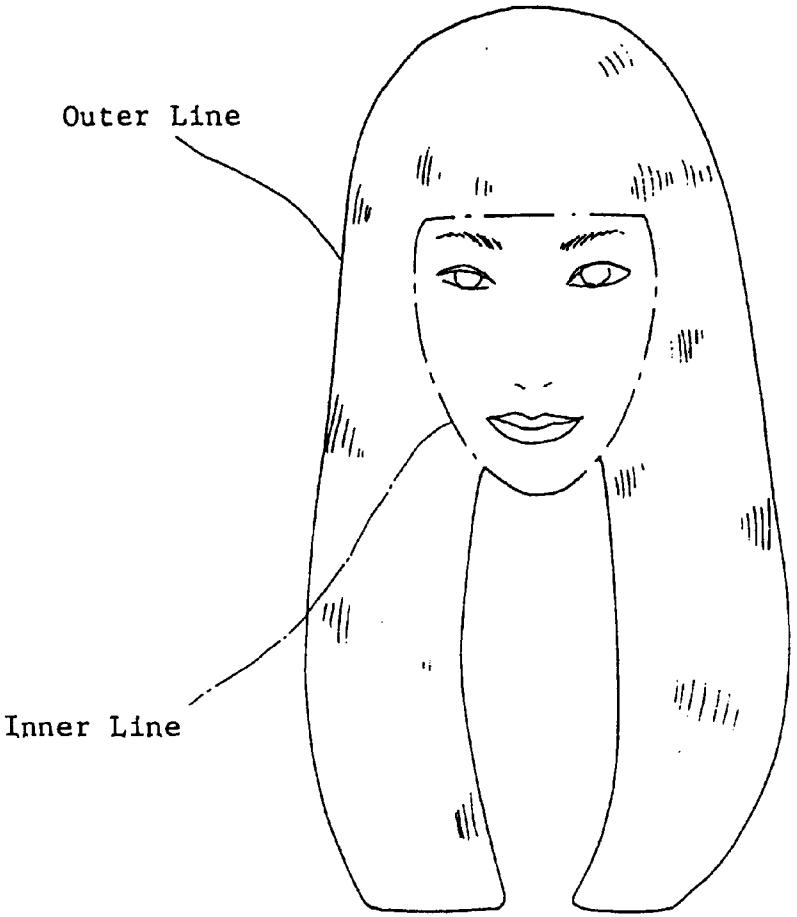
Figure 27A:
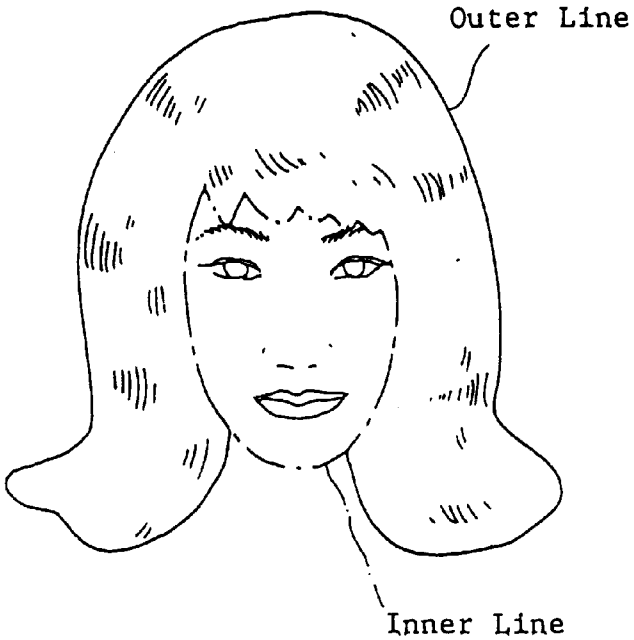

Two figures of FIG. 27A and FIG. 27B show to emphasize long faces.

Figure 28:
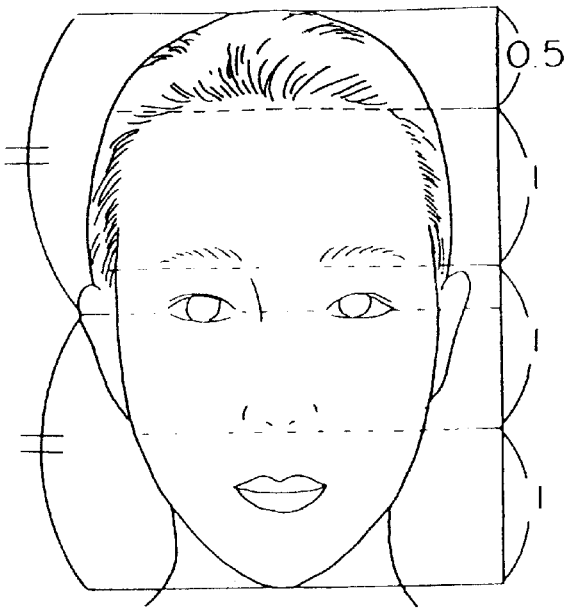

FIG. 28 is an explanatory illustration for a standard proportion.

Figure 29:
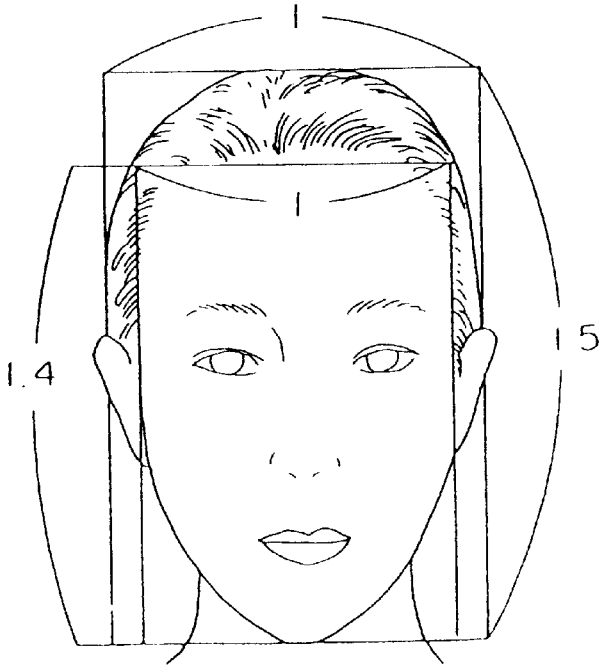

FIG. 29 is also an explanatory illustration for a standard proportion.

Figure 30:
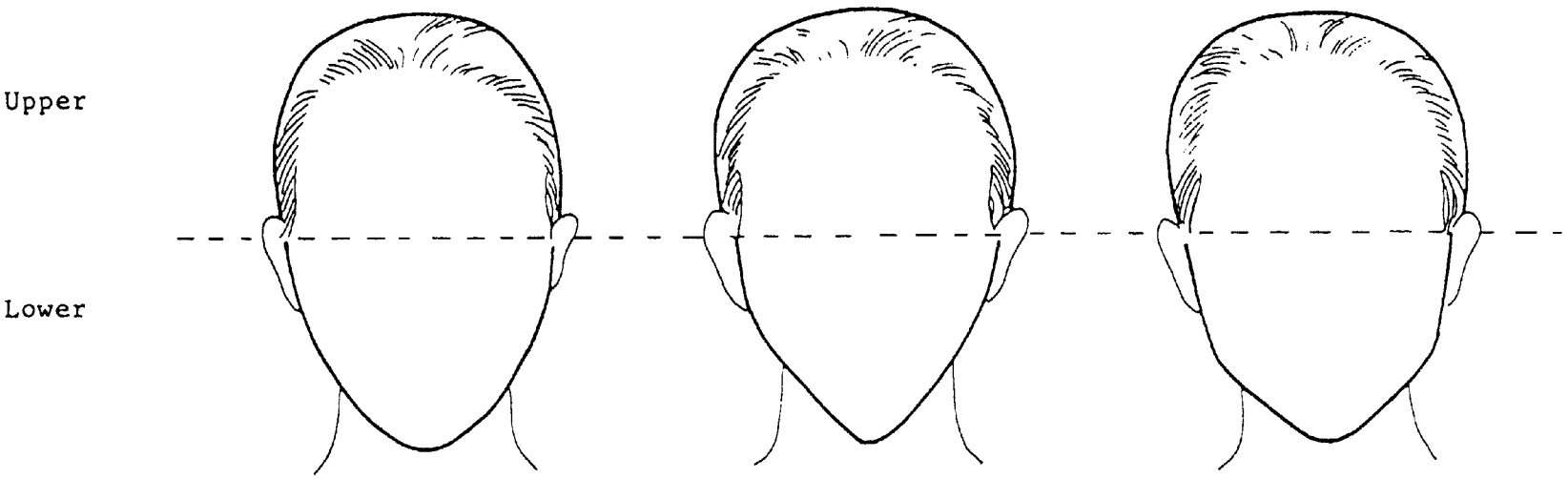

FIG. 30 is an explanatory illustration for an egg shape proportion.

Figure 31:
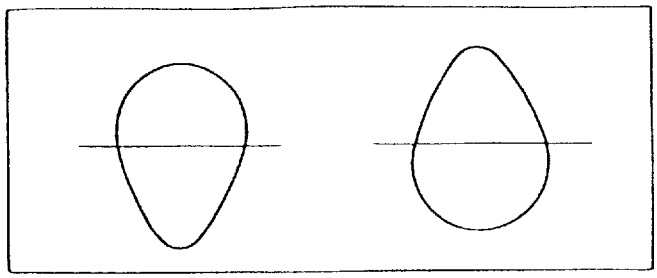
Figure 31:
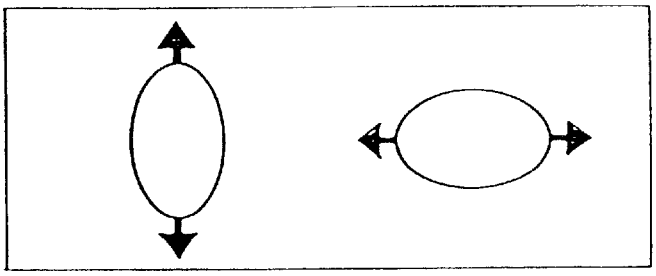
Figure 31:
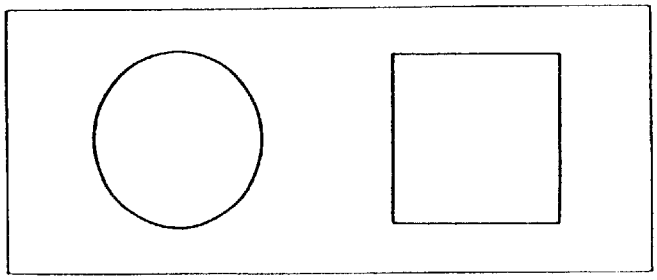
Figure 31:
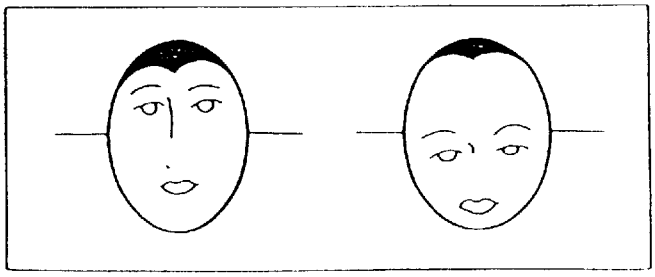

FIG. 31 shows four illustrations for analyzing a procedure for shape and balance.

Figure 32C:
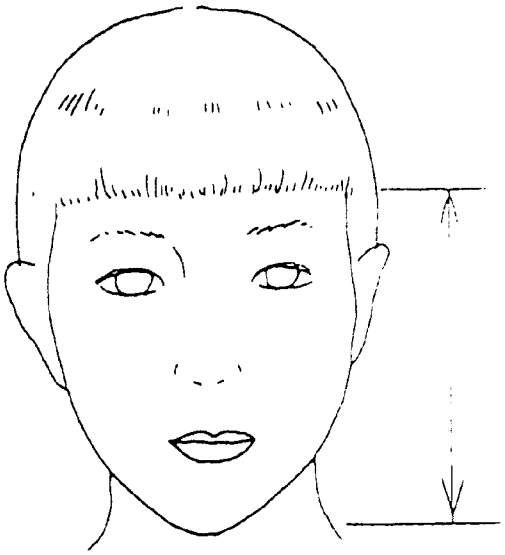
Figure 32B:
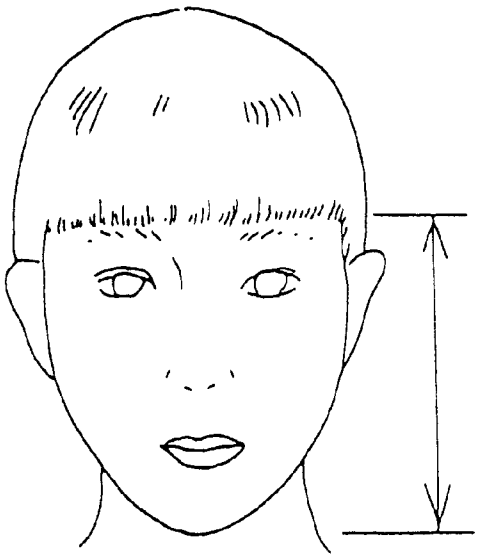
Figure 32A:
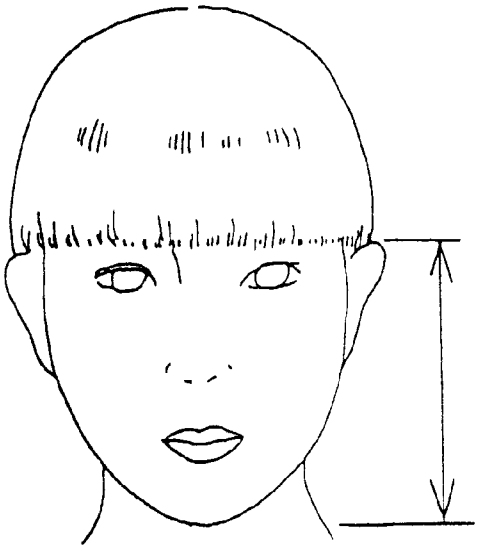

Three figures of FIG. 32A, 32B and FIG. 32C show a first principle of effects brought by hair-style arrangement.

Figure 33B:
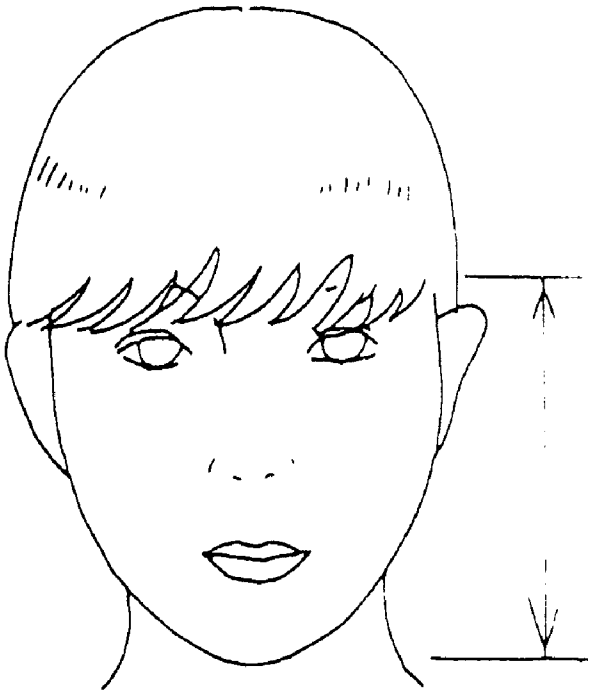
Figure 33A:
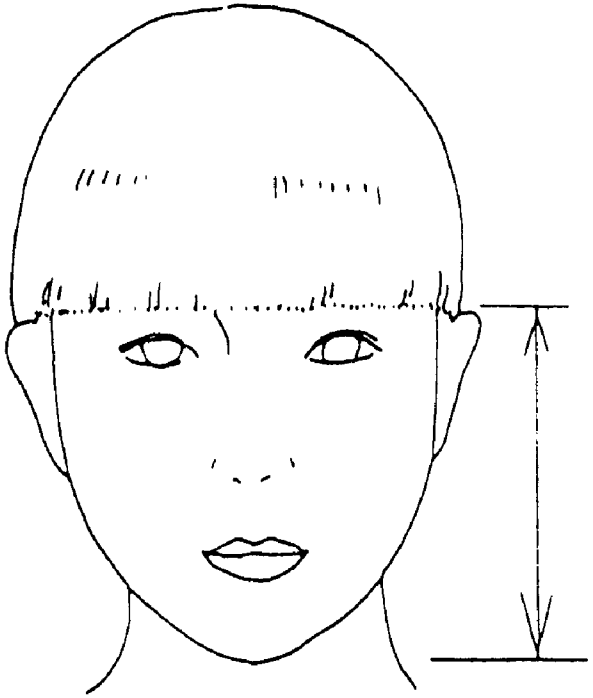

Two figures of FIG. 33A and FIG. 33B show a second principle of effects.

Figure 34B:
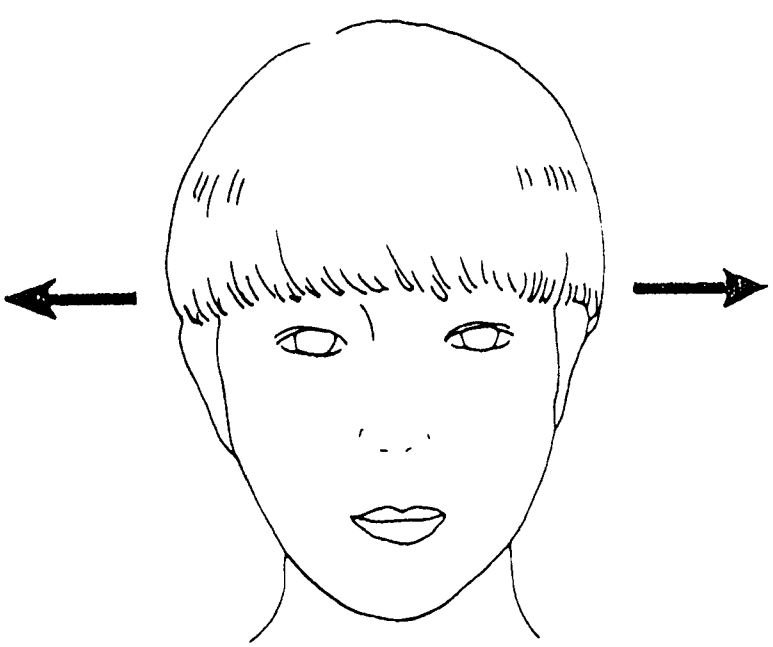
Figure 34A:
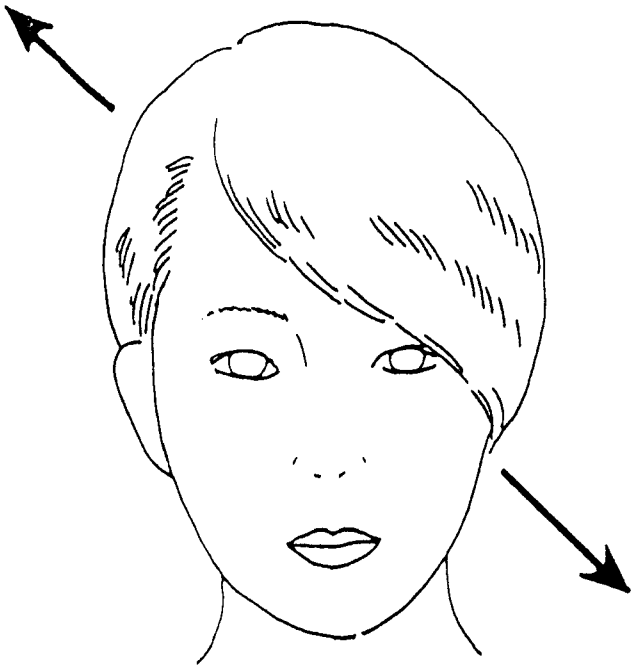

Two figures of FIG. 34A and FIG. 34B express a third principle of effects.

Figure 35C:
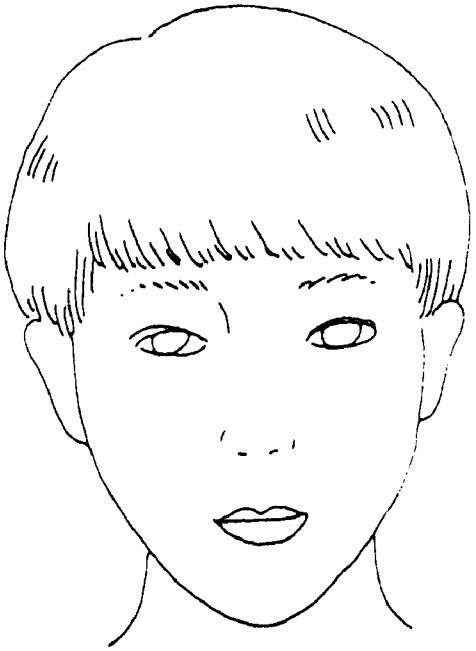
Figure 35B:
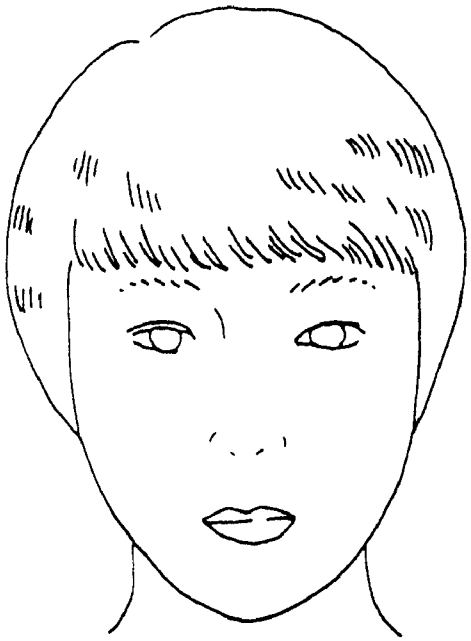
Figure 35A:
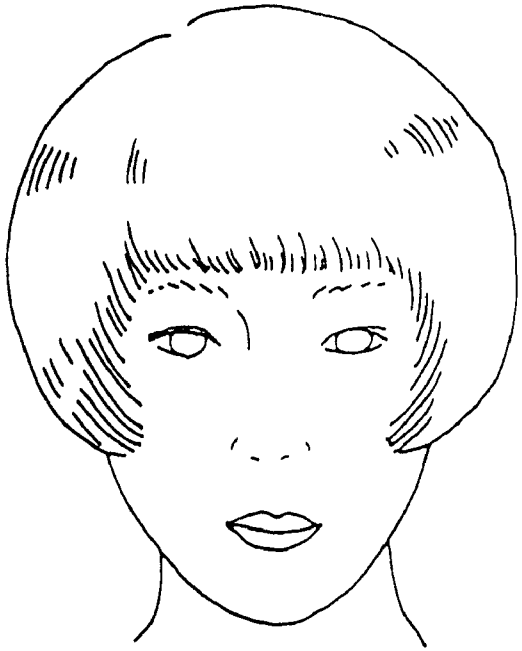

Three figures of FIG. 35A, 35B and FIG. 35C show a fourth principle of effects.

Figure 36C:
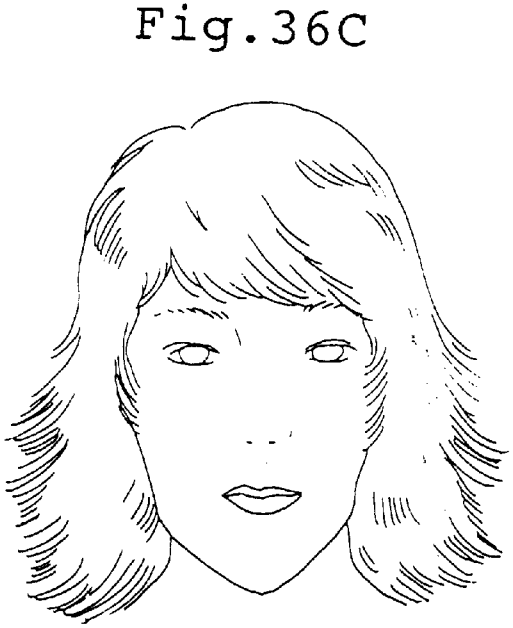
Figure 36B:
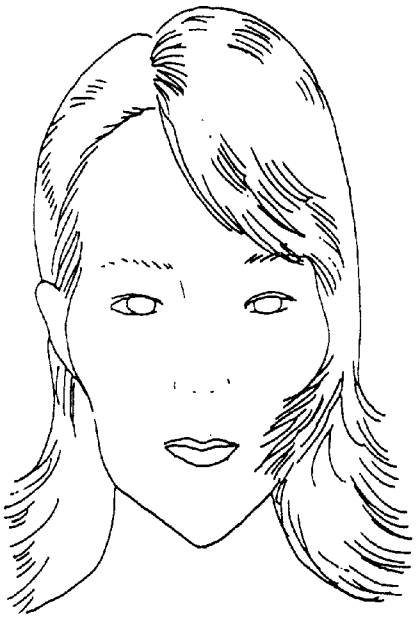
Figure 36A:
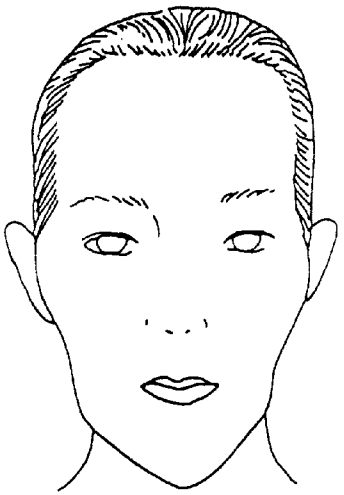

Three figures of FIG. 36A, 36B and FIG. 36C show a procedure to create a good image for a long and angular face by hair-style arrangement.

Figure 37C:
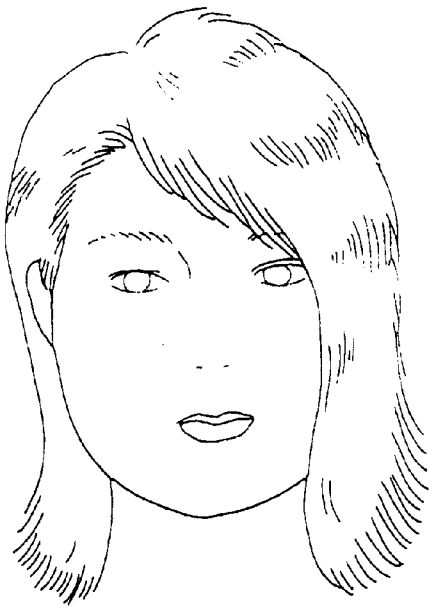
Figure 37B:
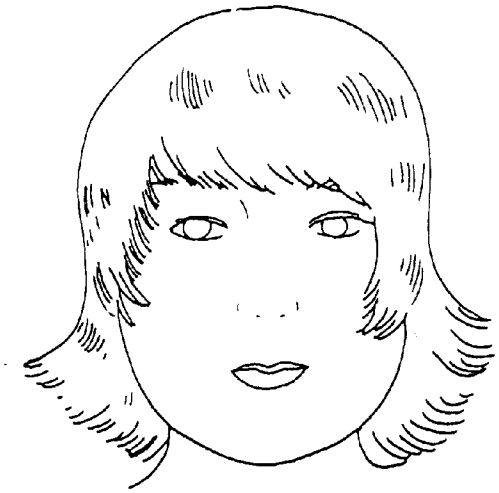
Figure 37A:
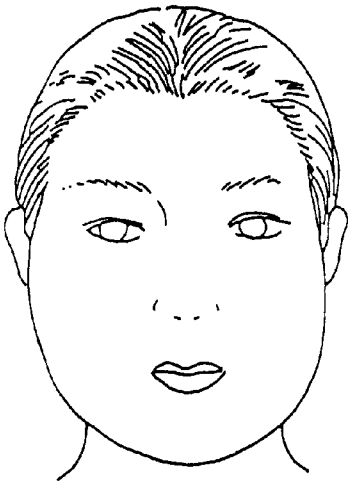

Three figures of FIG. 37A, 37B and FIG. 37C show a procedure to create a good image for a round face by hair-style arrangement.

Figure 38:
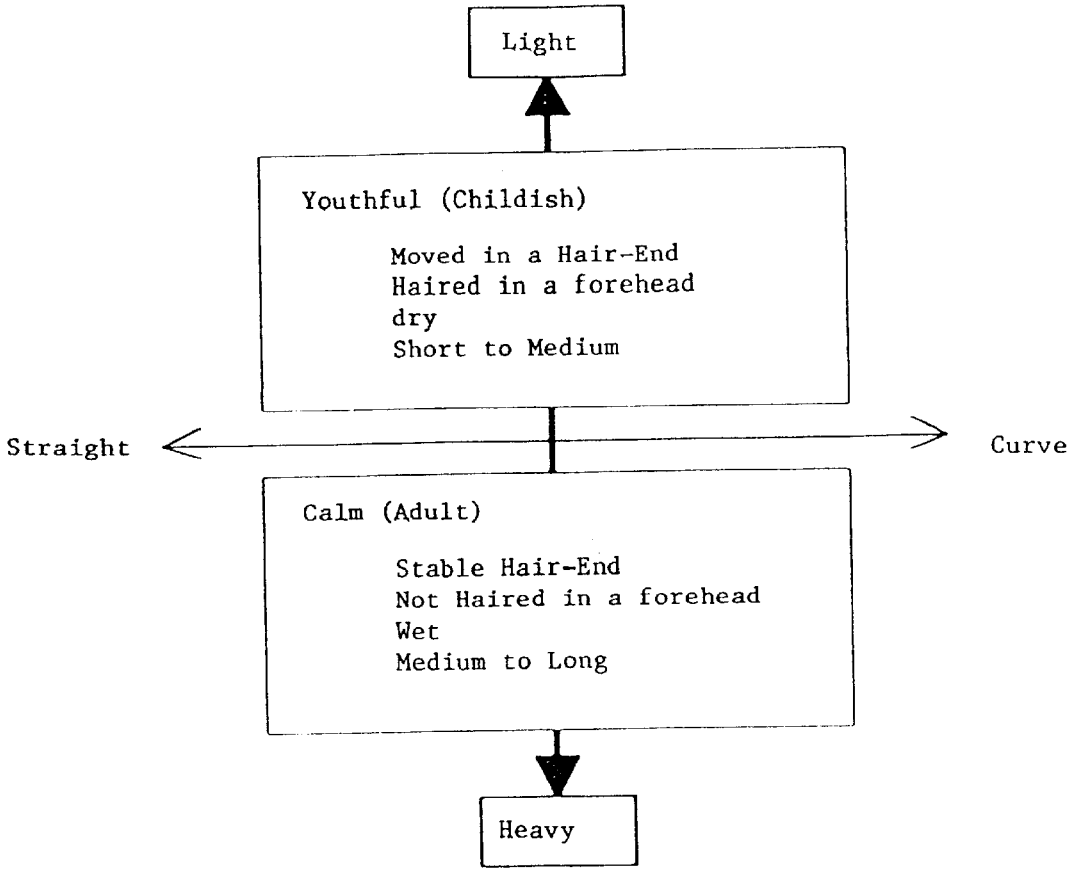

FIG. 38 is an illustration map to express "light" and "heavy" image to create a perpendicular axis.

Figure 39:
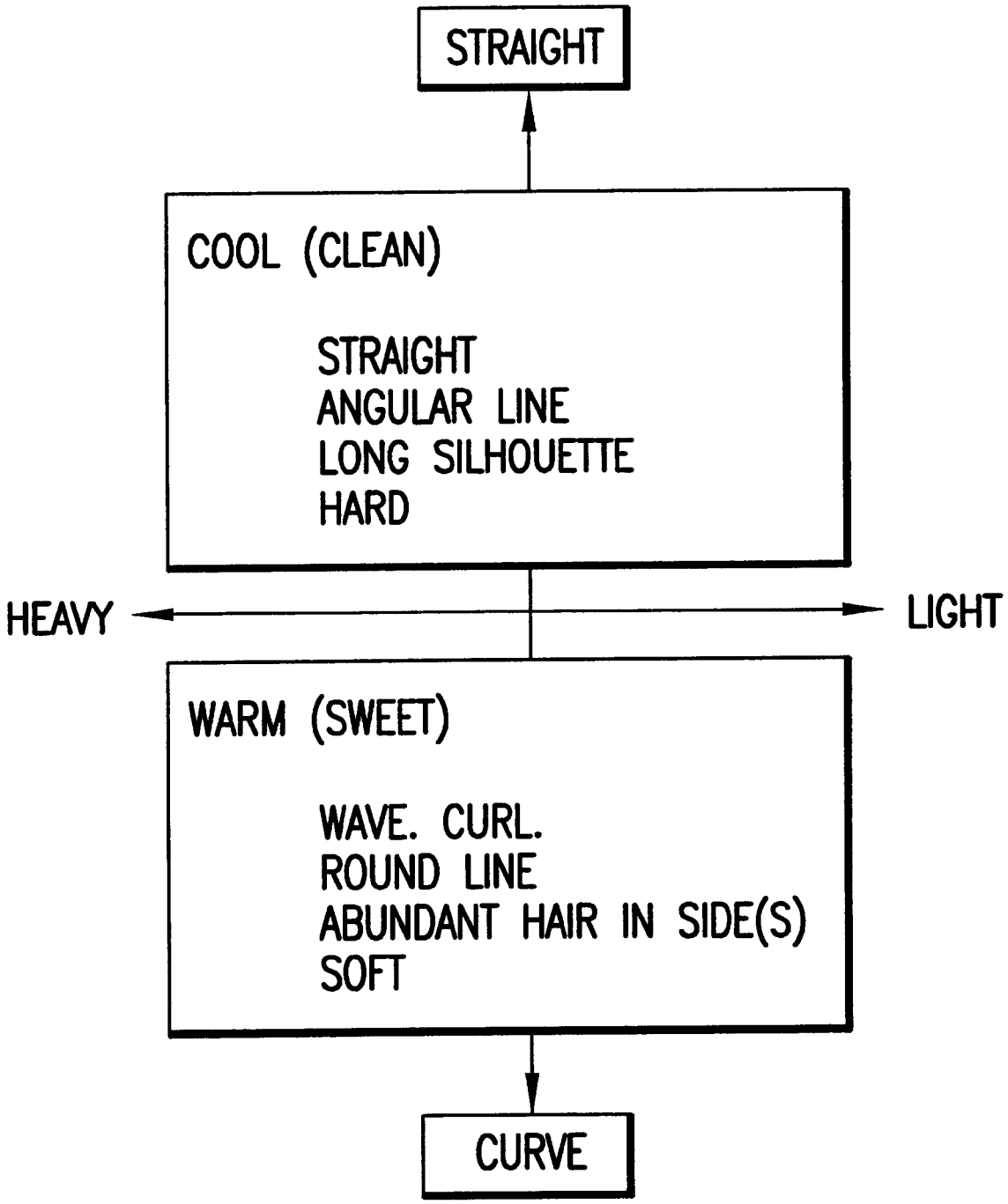

FIG. 39 is an illustration map to express "straight" and "curve" images along a horizontal axis.

Figure 40:
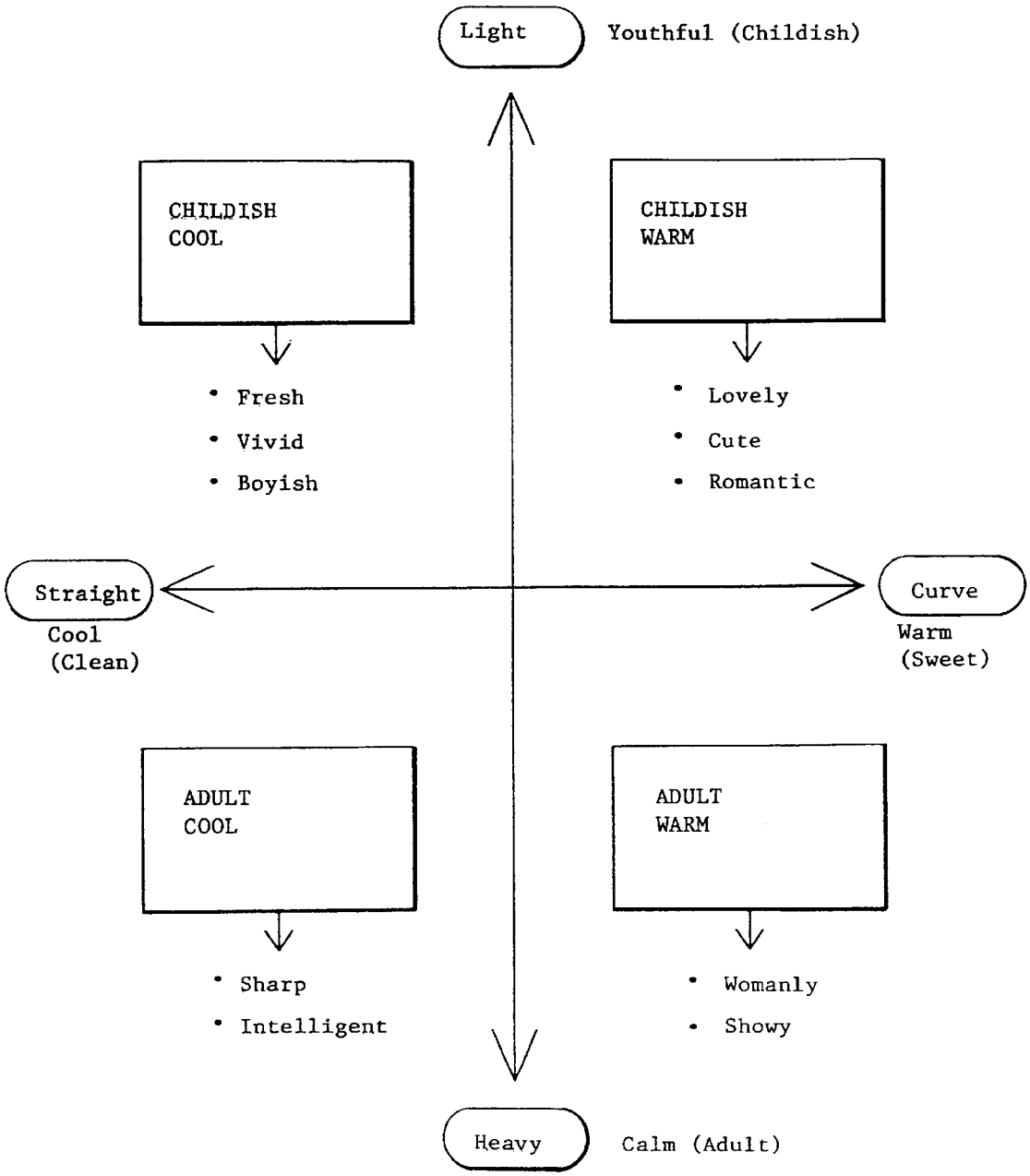

FIG. 40 is an illustration drawing for images of hair-styles on an axis of co-ordinates.

Figure 41:
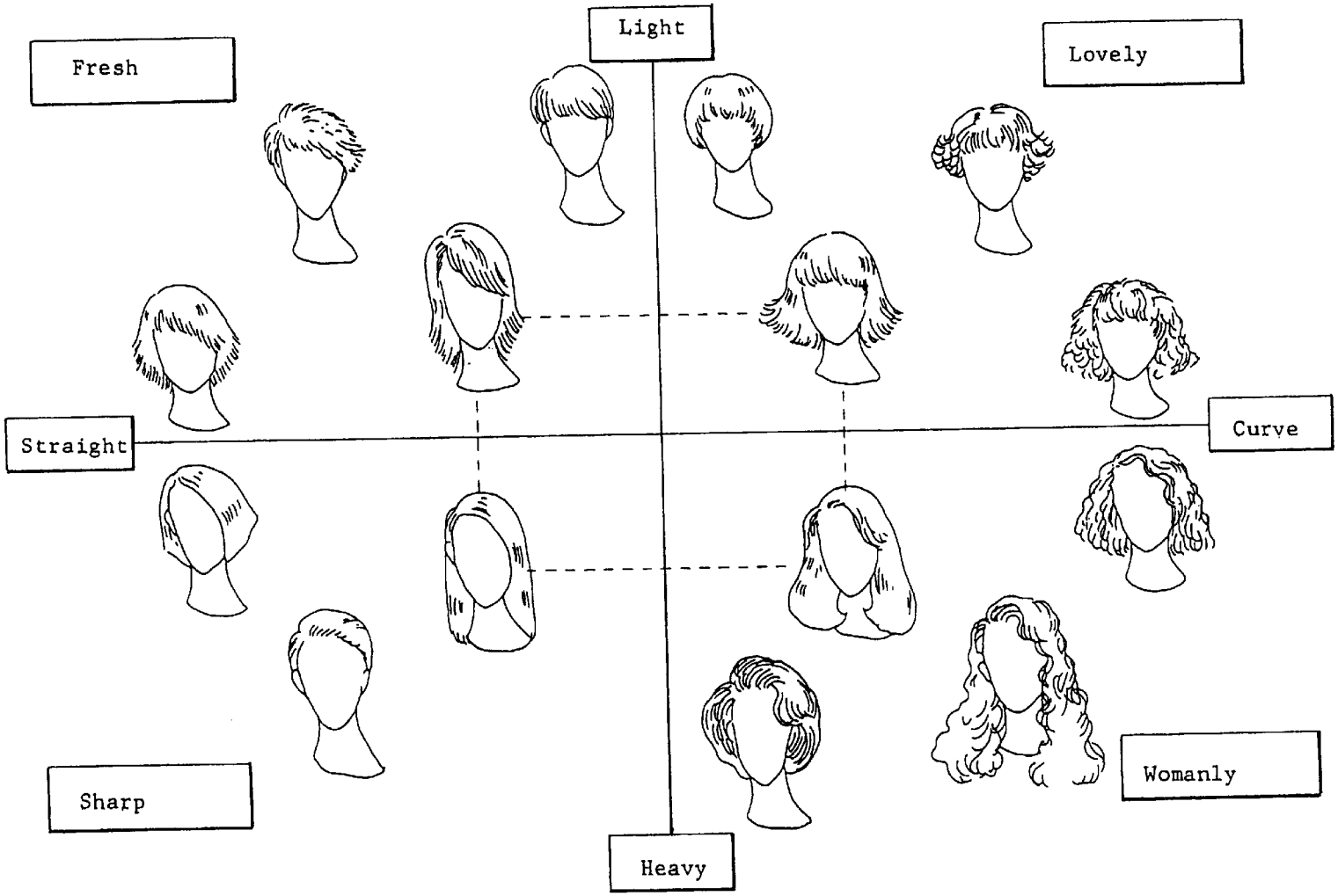

FIG. 41 is an illustration map for arranging various hair-styles represented by images on an axis of co-ordinates.

Figure 42:
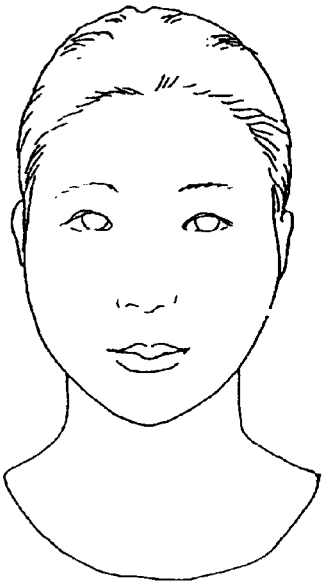

FIG. 42 is a face of a Model A.

Figure 43:
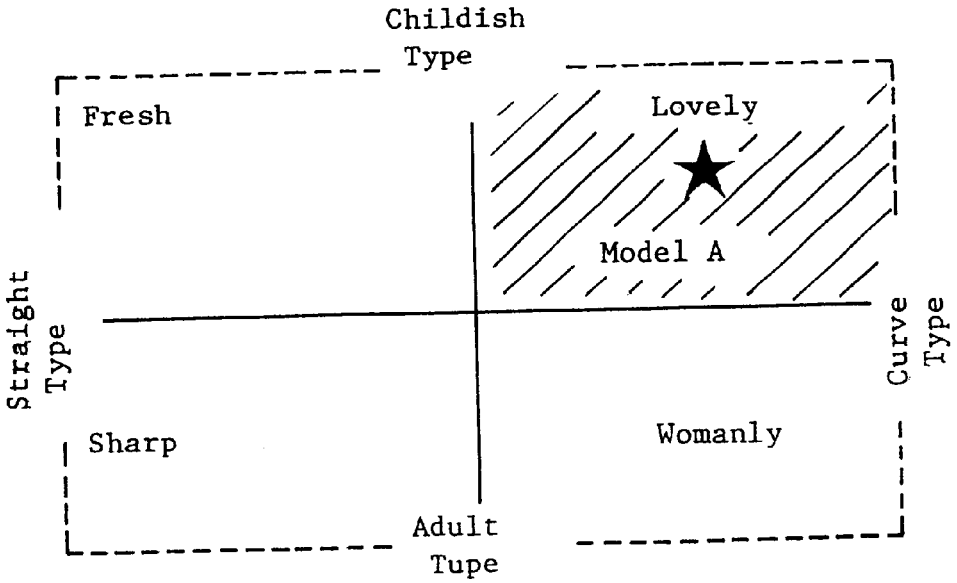

FIG. 43 is an illustration drawing which expresses the requirements of said Model A.

DESCRIPTIONS OF THE PREFERRED EMBODIMENT

The preferred embodiments are now explained hereunder.

This invention has developed an inner line which constitutes a boundary line between a face and a hairline and an outer line which constitutes an outside of the hair style, through which a contour of the face and its image are defined for selecting a hair-style, and then it is analyzed to determine whether the selected hair-style is suitable in its form and balance and whether the selected style is also suitable for the image. Thus the suitable selection of the hair-style is adopted.

At the same time, in reference with FIGS. 38, 39, 40 and 41, an image for "light" and "heavy" is placed on a perpendicular axis, while in reference with FIGS. 14, 38, 39, 41 and 43, an image for "Straight line" and for "Curve line" is also placed on a horizontal axis, so that some representative hair-styles expressing those images are arranged as a hair-style image map.

The present inventors have made an enquiry among more than thirty professional beauticians and offered them questionnaires asking whether or not actual photographs with some hair-styles are suitable thereof or not. They were also asked the relative reasons. The answers to these questions regarding hair styles yielded the following reasons for unsuitability:

"The contour of the face such as a round face, angular face, narrow forehead and so on, is too much emphasized", "The face comes too big", "The head portion comes too big", "The lower part of the face comes too big for the round face", "Heavy", "Unclean feeling", "Ill-health feeling", "Dark", "Quiet", "Poor", "Too old", "Antique", "Unnatural", "Like a wig wearing" and so on". Now, these causes are assorted out as the following factors.

1. Factor 1 Balance and Formation of the hair-style.
2. Factor 2 Image.

With regard to the above two factors, they are further analyzed, and for the factor 1, five elements are adopted, while for the factor 2, two elements are adopted as below:

Factor 1.

- Element 1: Balancing between upper and lower parts of a face.
- Element 2: Silhouette
- Element 3: Contour of the face (=face line) is too much emphasized.
- Element 4: Balancing between the size of a head and that of the face.
- Element 5: Balancing in total in consideration of space balance.

Factor 2.

- Element 1: An impression on the selected hair-style.
- Element 2: An image gap between face features and a selected hair-style.

According to the above theory, in case if we decide a hair-style based on the above factors and elements, we can select the suitable hair-style.

Now, with refererence to the drawings, we will explain each element in detail.

Figure 1A:
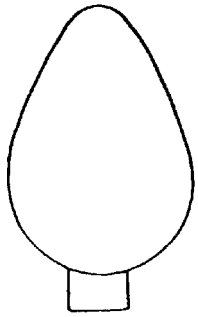
FIG. 1A is a basic shape of a face.
Figure 1B:
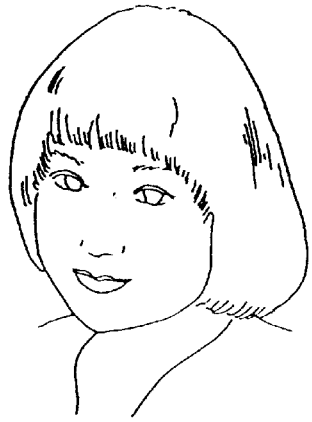
FIG. 1B is an actual hair-style, wherein the lower half of the face looks too wide.

Referring to FIGS. 1A and FIG. 1B, a volume of hair is spread out horizontally so that the face looks too wide and it is an example of Factor 1—Element 1 wherein "Balancing between upper and lower parts of a face" is shown.

Figure 2A:
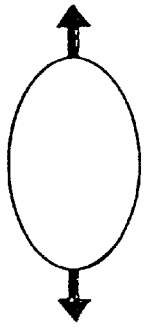
FIG. 2A is a basic shape of a face.
Figure 2B:
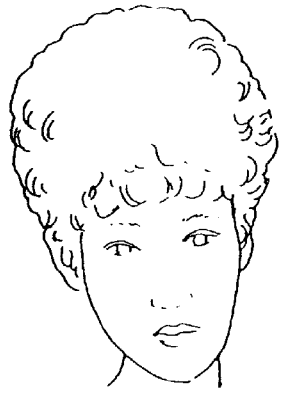
FIG. 2B is an actual hair-style, wherein the face and hair style look too long.
Figure 3A:
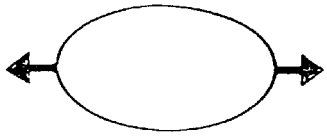
FIG. 3A is a basic shape of a face.
Figure 3B:
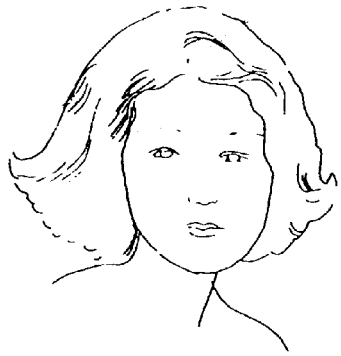
FIG. 3B is an actual hair-style, wherein the total face and hair style look too wide.

With reference to FIGS. 2A and 2B, wherein a volume of hair exists on the upper side the face looks too long, and with reference to FIGS. 3A and 3B, wherein a volume of hair exists sideways the face looks too wide. These two examples illustrate Factor 1—Element 2 which is called "Silhouette".

Figure 4A:
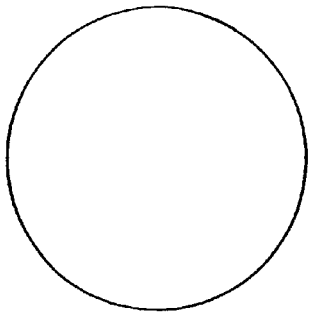
FIG. 4A is a basic shape of a face.
Figure 4B:
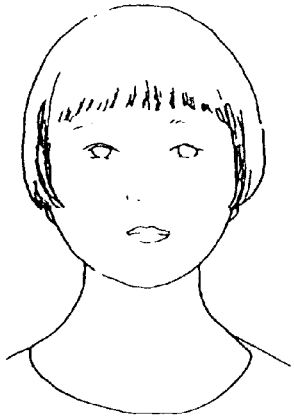
FIG. 4B is an actual hair-style, wherein lines of a forehead and a jaw look too round.
Figure 5A:
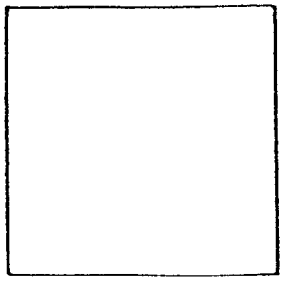
FIG. 5A is a basic shape of a face.
Figure 5B:
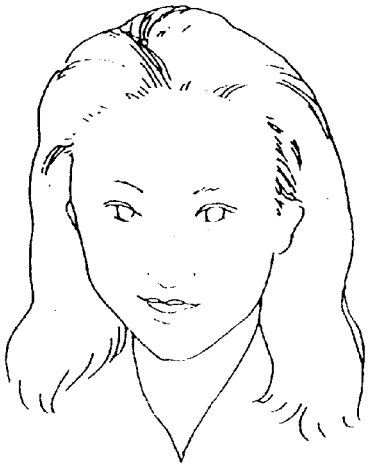
FIG. 5B is an actual hair-style, wherein the corners of a forehead and a jaw look too angular, so that an image is too strong and unfeminine.

With reference to FIGS. 4A and 4B, wherein both of forehead line and jaw line are much too clearly expressed so that the appearance of being smart for the face is lost, and with reference to FIGS. 5A and 5B, wherein each comer of the forehead and jaw line are shown too angular so that femininity of the face is lost. These two examples are true of Factor 1—Element 3 which is called "Contour of the face (=face line) is too much emphasized".

Figure 6A:
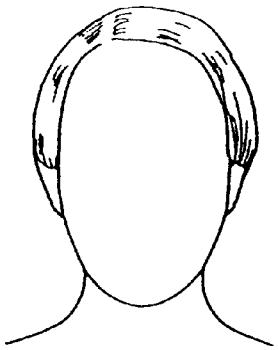
FIG. 6A is a basic shape of a face with a volumeless hair.
Figure 6B:
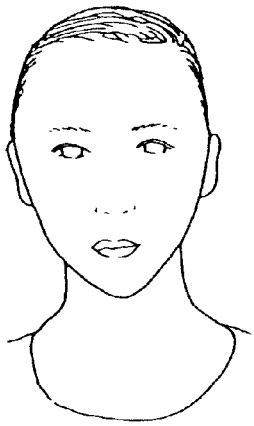
FIG. 6B is an actual hair-style, wherein these two examples show their head portion to be too flat.
Figure 7A:
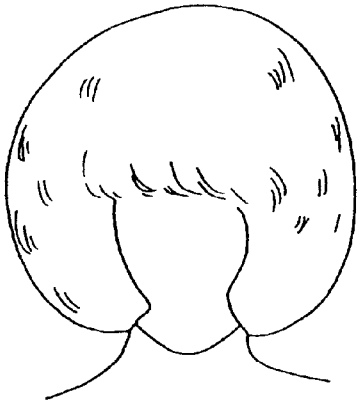
FIG. 7A is a basic shape of a face with a bulky hair style.
Figure 7B:
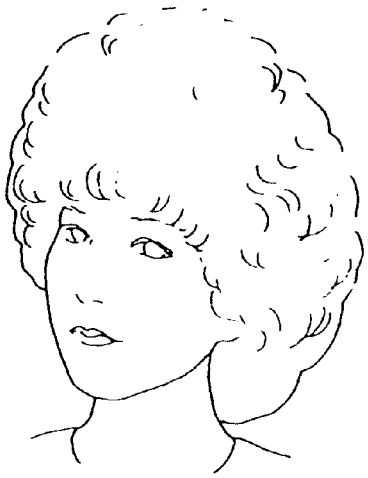
FIG. 7B is an actual hair-style, wherein these two examples show some badly balanced hair styles.

With reference to FIGS. 6A and 6B, wherein a small volume of hair is present so that the head portion looks too small, and with reference to FIGS. 7A and 7B, wherein a volume of hair is present so that total balance for the face and hair is not correct. These two examples illustrate Factor 1—Element 4 which is called "Balancing between the size of the head and that of the face".

Figure 8:
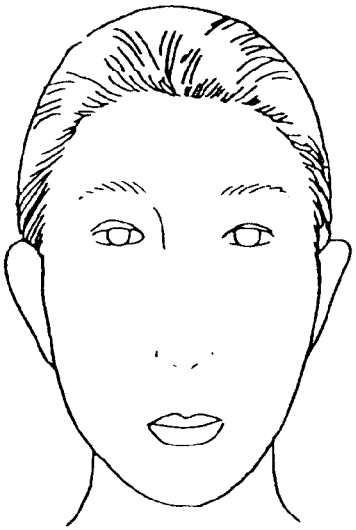
FIG. 8 is an actual hair style, wherein a narrow forehead and a high arrangement of eyes are shown as an example of undesirable situation.
Figure 9:
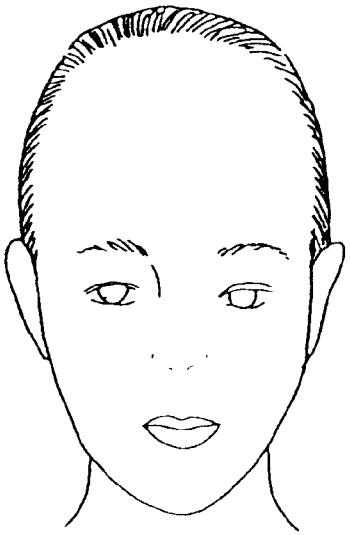
FIG. 9 is an actual hair-style, wherein a wide forehead and a low arrangement of eyes are shown in contrast with the above FIG. 8.

FIG. 8 shows a forehead which is very narrow so that the place of the eyes is too high. FIG. 9 shows a forehead which is very wide, so that the place of the eyes is too low. These two examples demonstrate Factor 1—Element 5 which defines "Balancing in total in consideration of space balance". Thus, a good balance should be considered not only for face portion only but also for head portion.

Figure 10:
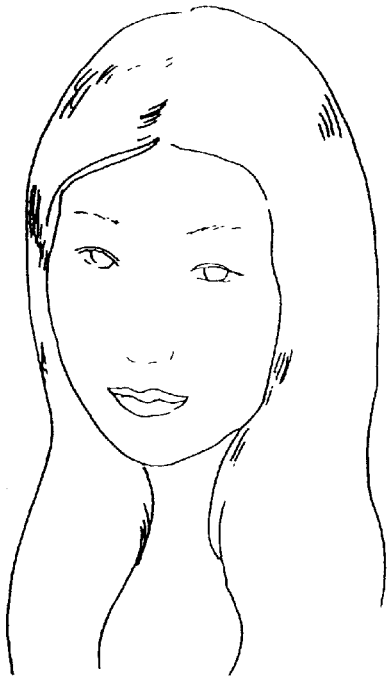
FIG. 10 is an actual hair-style, wherein an image of the hair-style looks unclean.
Figure 11:
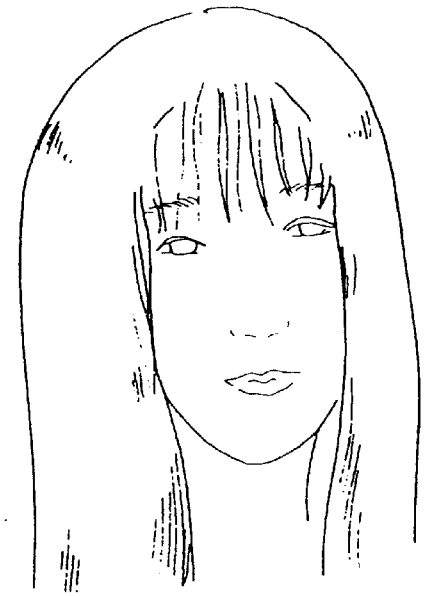
FIG. 11 is an actual hair-style, wherein an image of the hair-style looks ghostly.
Figure 12:
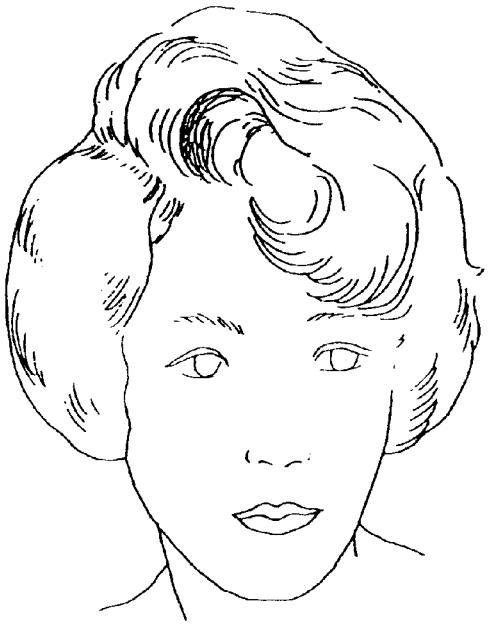
FIG. 12 is an actual hair-style, wherein an image of the hair-style is too old fashioned.
Figure 13:
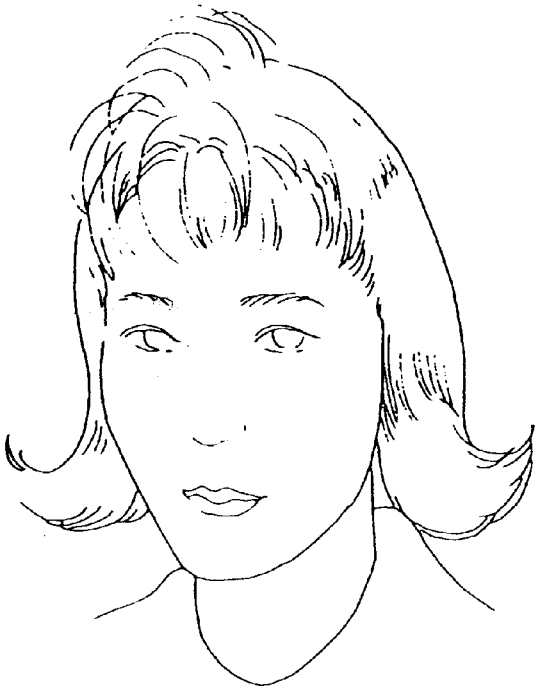
FIG. 13 is an actual hair-style, wherein an image of the hair-style is unnatural.

Concerning Factor 2—Element 1 which defines "An impression", relative examples are shown in FIG. 10 for unclean feeling, FIG. 11 for ghostly feeling, FIG. 12 for too old, and FIG. 13 for unnatural.

Regarding Factor 2—Element 2 which defines "Image gap", it is proposed that there is older women as compared to very young women suitable hair-style for the form. If the image gap is present, the hair style does not fit to the age. The hair style therefore is considered not suitable.

The present inventors have developed a panel on which various hair-styles are arranged and assorted with various faces from 20 year old and 50 year old ladies, based on which further questionnaires are presented to beauticians.

Figure 14:
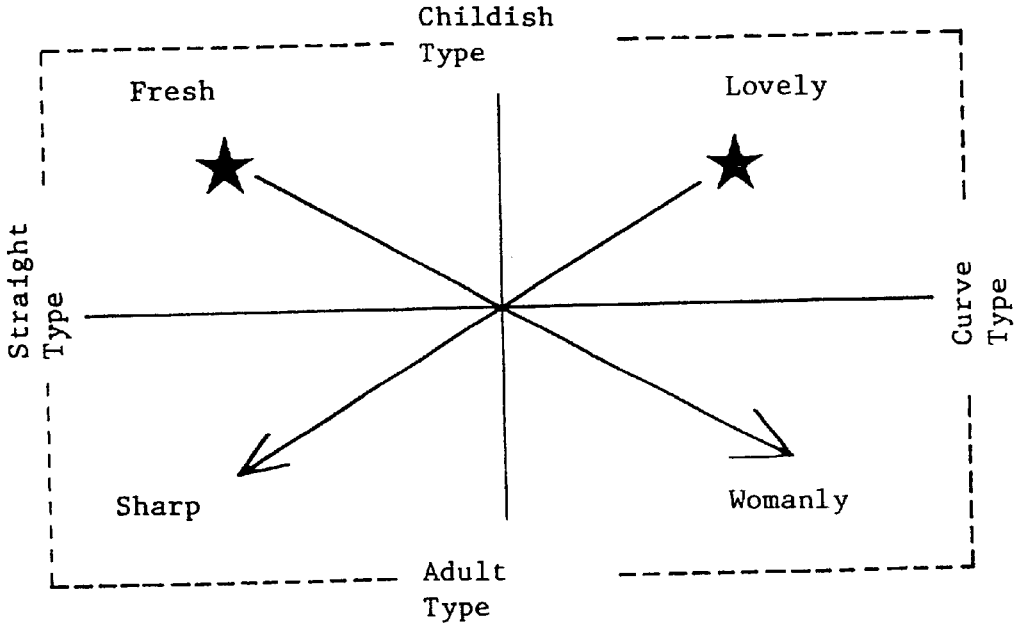
FIG. 14 is a guide chart map to show the formation of a face construction.
Figure 15:
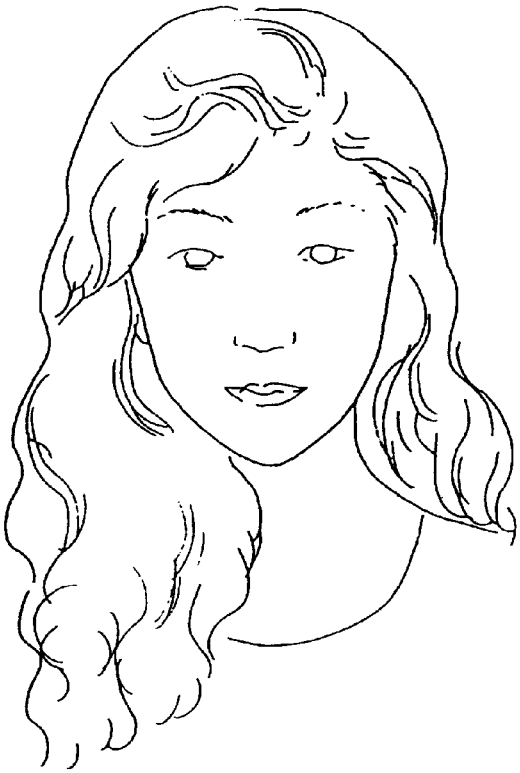
FIG. 15 is an actual hair-style which gives a cool and fresh impression.
Figure 16:
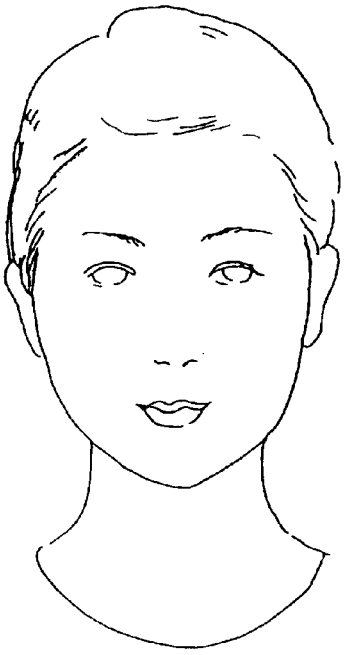
FIG. 16 is an actual hair-style equipped with in a lovely condition.
Figure 17D:
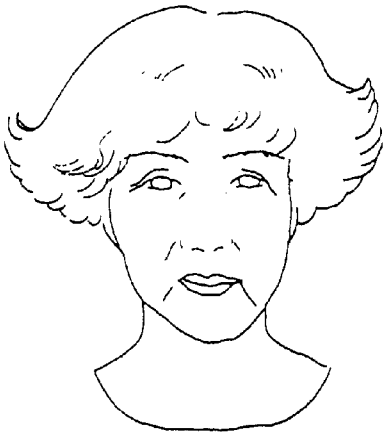
Figure 17C:
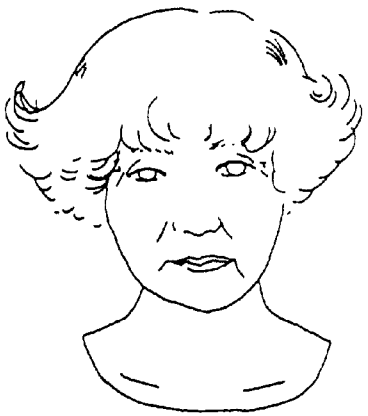
Figure 17B:
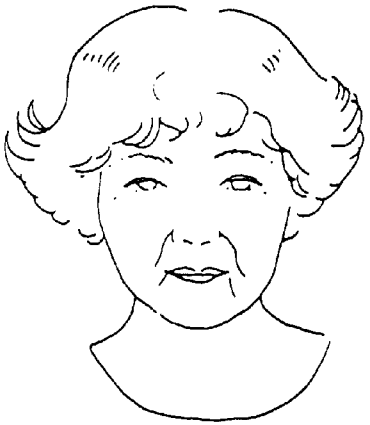
Figure 17A:
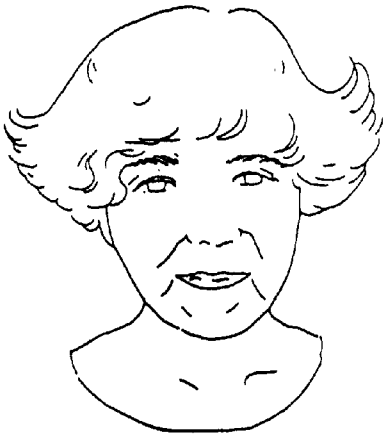
Figures 18A, 18B, 18C, 18D:
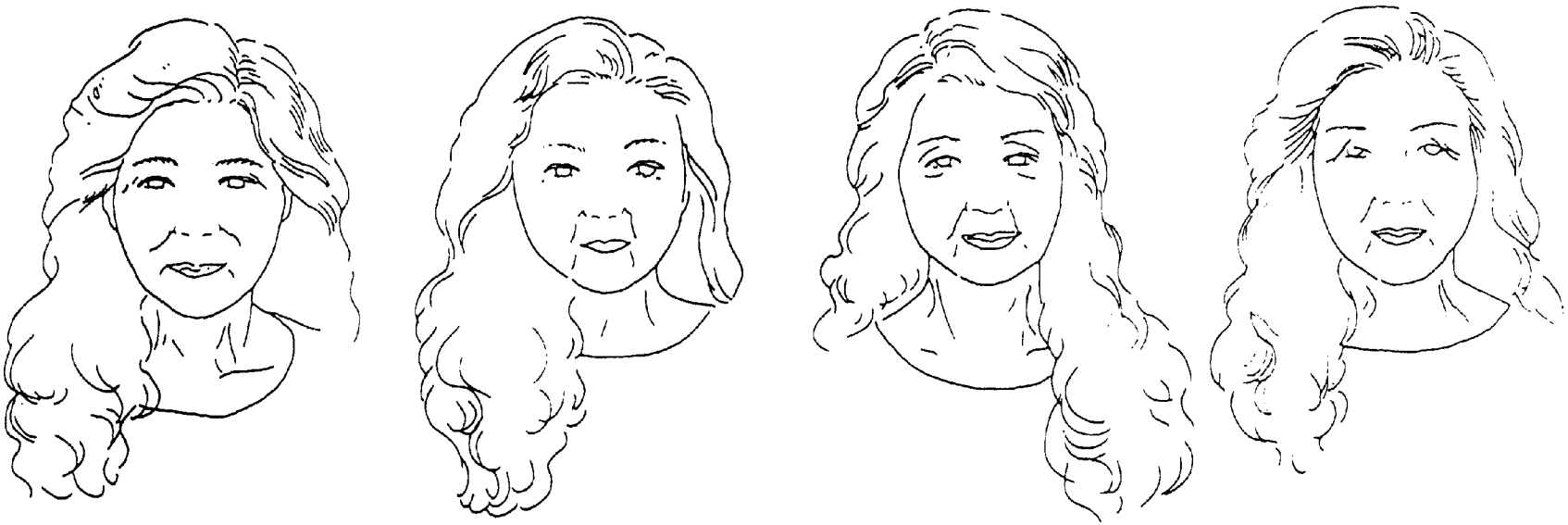
Figure 19D:
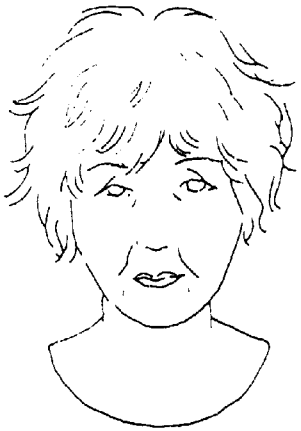
Figure 19C:
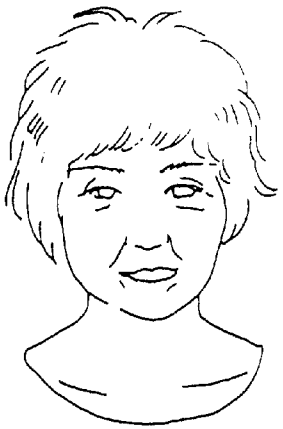
Figure 19B:
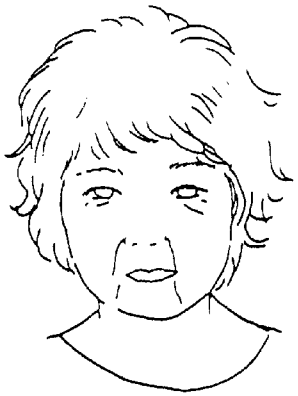
Figure 19A:
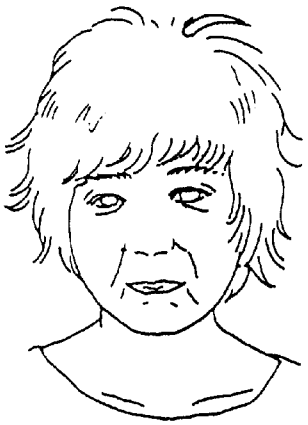
Figure 20D:
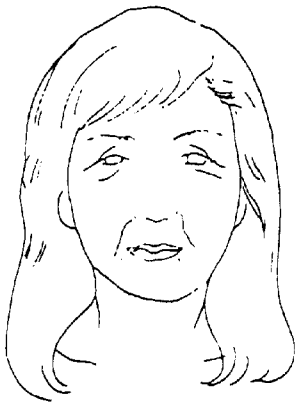
Figure 20C:
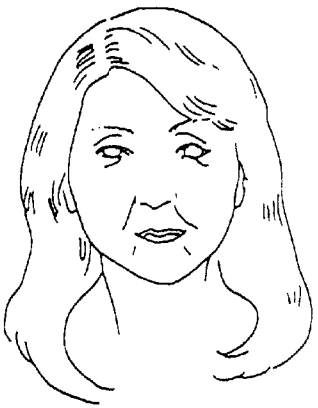
Figure 20B:
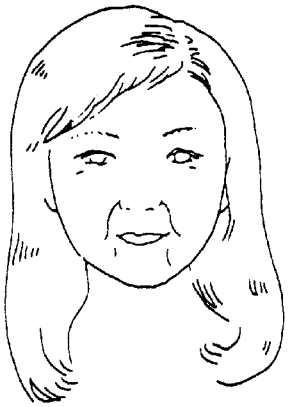
Figure 20A:
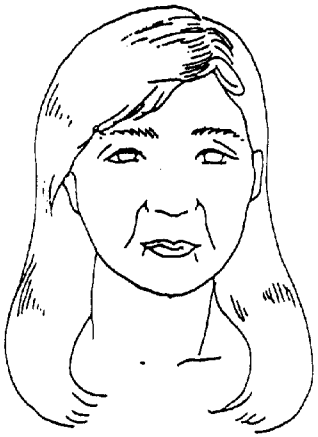

As a result, it is proved that for 20 year old ladies a hair-style which is too far apart from their image is not suitable. For instance, as shown in FIG. 14 in which there are two diagonal lines, one line is "Fresh" against to "Womanly" while the other line is "Lovely" against to "Sharp". According to these diagonal lines, a fresh and cool faced lady of 20 year old is not suitable with a womanly long hair style as shown in FIG. 15. On the other hand, a lovely faced lady of 20 year old is not suitable with a sharp and cool hair style at all.

With regard to women of 50 years, the age should be regarded as a more important than their faces. Therefore, a hair-style for a young woman may be regarded as improper and not suitable. Referring to FIGS. 17A, 17B, 17C and 17D, wherein the forehead is concealed by forehair with curling hairs, these hair-styles look too childish and are not suitable.

With reference to FIGS. 18A, 18B, 18C and 18D, where sexy feeling is emphasized with waved long hairs, these hair-styles do not offer any calmness for the age.

Referring to FIGS. 19A, 19B, 19C and 19D, where a wild image is emphasized with short hairs of straight touch, these hair-styles, same as FIG. 18, do not offer any calmness for the age.

In reference to FIGS. 20A, 20B, 20C and 20D, where the cleanliness of clean and refreshed feeling is emphasized with long hairs of straight touch, these hair-styles lack calmness and comfort of comfortable and/or pleasant feeling for the age.

During the steps and procedures to analyze and to study the suitable hair-style, it is found that some styles are suitable for any lady. In other words, as shown in FIGS. 21A, 21B, 21C, 21D, 21E and 21F, where short hair with forehairs or bangs is worn in natural situations under egg-shape silhouettes, such hair-styles are suitable for both of 20 year old and 50 year old ladies.

Referring to FIGS. 22A and 22B, where straight and natural long hair is shown, such hair-styles are quite suitable for 20 year old ladies.

Referring to FIGS. 23A and 23B, where gently waved hair is short and medium in length, such hair-styles are suitable for 50 year old ladies.

As a result of the enquiry, the viewpoints of the beauticians for analization are mostly on a total contour of the applicant, and then,jaws, foreheads, images, forms of the heads, length of the necks, measurement of the cheek, and the balance of the whole style. These individual viewpoints are subjective and should be regarded as important facts, but it is quite troublesome to make all such analysises thereupon. These viewpoints are also influenced upon by individualities of the beauticians, and for amateur beautician it is quite difficult to make such analysises. In order to avoid these difficulties, the present inventors have found a more objective inner line and outer line for easier analysis in stead of these viewpoints.

With reference to FIGS. 24, 25, 26A and 26B, the inner line means a boundary line between the face and the hairline. Especially for FIG. 25, in case if the hairline is concealed by forehairs, the inner line should be considered to be the line formed by the forehairs and the face. The outer line means the line for the outside of the hair style, and refers to the silhouette. When the inner line and the outer line are compared with in FIG. 26, it should be understood that the hair-style of FIG. 26B is more angular in square than that of FIG. 26A. The face of FIG. 27B looks longer than that of FIG. 27A. Thus, when this inner line and outer line are checked, the contour of the face and its image created by the selected hair-style can be clearly known.

Now, it is now studied what is the most preferable hair-style by adopting this inner line and outer line theory. In the prior art, a standard proportion for the face was already developed, and taking this standard proportion into account including head portions, a value of the standard proportion for the hair-style was calculated.

FIG. 28 and FIG. 29 show the standard proportion developed by this invention. In reference to these figures, the standard proportion is found by considering:

1. The placement of eyes in the center.
2. The proportion ratio between distance from the eyes to the top end of the hair style and distance from the eyes to a bottom end of a jaw is 1:1.
3. The proportion ratio between length of the forehead, distance from the bottom of the forehead to a nose tip and distance from the nose tip to the bottom of the jaw is 1:1:1.
4. The proportion ratio between length of the forehead and distance from the top end of the forehead at the hairline to the top of the hair style is 1:0.5.
5. The proportion ratio between length and breadth of the face including the head and hair is 1.5:1.
6. The proportion ratio between length and breadth of the face only is 1.4:1.

When the balance is checked based on this standard proportion, the important point is that a good balance should be kept lengthwise and sideways in the center placement of the eyes.

As shown in FIG. 30, a beautiful proportion is provided in the egg-shape face. In this case, the shape of the jaw does not offer any effect at all even if it is round or angular. This proportion has obtained the beautiful condition.

Referring to this standard proportion, through the adoption of the inner line and the outer line, features of the head and the face are observed for analization.

With reference to FIG. 31, ANALYSIS 1 probes the hair-style by the inner line and the outer line. By this checking, Factor 1—Element 1 of "Balancing between upper and lower parts of the face" is proved and also Factor 1—Element 4 of "Balancing between the size of the head and that of the face" is proved. Next, ANALYSIS 2 probes lengthwise and sideways to analyze Factor 1—Element 2 "Silhouette". Thirdly, ANALYSIS 3 proves Factor 1—Element 3 of "Face line is to much emphasized". On the last and fourthly, ANALYSIS 4 proves Factor 1—Element 5 of "Balancing in total, space balancing". Thus, all questions with regard to Factor 1—from Element 1 to Element 5 are clearly analyzed. With this analysis method, the unsuitable hair-styles shown in FIG. 1~FIG. 9 are analyzed accordingly, and as a result the relative causes not to be suitable are obtained.

As explained above, the simple analysis can be made for Factor 1 of "Balance and Formation of the hair-style". In addition to this analysis, Factor 2 of "Image" is also studied for Factor 2—Element 1 of "An impression" and for Factor 2—Element 2 of "Image Gap", so that desirable hair-styles can be selected. With regard to this Factor 2, this belongs to a prior art, and therefore the present invention does not claim any analysis method for the image.

After the above analization is finished, the bad elements should be corrected and the suitable hair-style should be recommended. In order to realize this correction, the present inventors made various trials for various hair styles by experimental photography. With these specimens for the hair-style, the inventors made an survey among professional beauticians, and collected relative data for analization. As a result of this search, it has been found 4 principles.

In reference to FIGS. 32A, 31B and 31C, the first principle is shown where forehairs become short the length of the face looks long.

In reference to FIG. 33A and FIG. 33B, the second principle is shown where forehairs are cut in straight line and the face looks short and clear and where forehairs are cut in irregular line and the face looks long and obscure.

In reference to FIGS. 34A and 34B, the third principle is shown where forehairs are placed in diagonal and the face looks long.

In reference to FIGS. 35A, 35B and 35C, the fourth principle is shown where the ears appear clearly out of side hairs and the lower parts of the face look long and clear.

The examples according to these principles are now shown.

Referring to FIGS. 36A, 36B and 36C, the hair-style of 36A shows an angular and long face with a small quantity of hair. This can be corrected to FIG .3 6B and 36C. When comparing FIG. 36B with 36C, the hair-style of FIG. 36C is arranged with a horizontal bank and with bulky hair, which gives the feeling of short hair with a short face, while that of FIG. 36B is arranged with diagonal forehairs and it does not look preferable.

In reference to FIGS. 37A, 37B and 37C, in contrast to the above FIG., a round face is submitted. In this case, FIG. 37C provides the impression that the face looks slim and long, while FIG. 37B provides the impression that the face looks wide and it does not look preferable.

When a client visits a beauty parlor, she may have her own image for her hair style in advance. Therefore, a professional beautician has to select a suitable hair-style for the client adopting her own image. Therefore, the inventors have developed a hair-style image map which shows mutual connections between an image and a hair-style.

With reference to FIGS. 38 and 39, the image map shows a chart on which images of "Light" and "Heavy" are presented in a perpendicular axis while lines "Straight" and "Curve" are presented in a horizontal axis. The light image means "Youthful" and "Childish", and the hair-style is "Moved in a hair-end namely curled or waved", "Bright hair color", "Hair on a forehead", "Dry", "Short to Medium cut", and this effects to make the face short. The heavy image means "Calm" and "Adult", and the hair-style is "Stable hair end", "Dark hair color", "No hair on forehead", "Wet" and "Medium to Long cut", and this effects to make the face long. The curve line has images of "Warm" and "Sweet" and the hair-style is "Wave curled", "Round line", "Abundant hair at the sides" and "Soft", and thus this effects to express a gentle contour. The straight line has images of "Cool" and "Clean", and the hair-style is "Straight", "Angular line", "Long silhouette", and "hard", and thus this effects to express a sharp contour.

With reference to FIG. 40, the above FIG. 38 and FIG. 39 are combined for clearer expression.

In accordance with these image maps of FIG. 38, FIG. 39 and FIG. 40, representative hair-styles are arranged, which is shown in FIG. 41.

With reference to FIG. 42, a model A is now counselled accordingly. The face of this model falls in the childish zone because her face looks short and he eyes and contour look round.

Referring to FIG. 43, this model A belongs to a zone of "Lovely". When her face is checked by the inner line and the outer line. The face looks round with thin hair. Her cheeks also look bulky. According to the analysis of "Formation and balance" adopted by the inner line and the outer line, the balance between upper and lower parts of the face shows that the lower parts look a little wide. When checking on lengthwise and sideways is performed, the face looks rather wide from side to side in sideways. The face line checking shows her face is a round type. The check for total balancing does not offer any problem at all.

The requests of this Model A is as follows

1. She normally looks childish, and therefore she would like to express herself as adult when she is working in her office.
2. In her private time, she would like to wear a fresh and trendy hair-style.

On checking the hair-style map shown in FIG. 40, her present hair-style falls in "Childish" and "Warm" on the right and upper zone, and her request 1 indicates the right and lower zone of "Adult" and "Warm". Her request 2 indicates the left and upper zone of "Childish" and "Cool". In order to meet her requests, the following corrections are made:

Request 1—The outer line is expanded vertically to make her face long by lifting her hair up, and her forehairs are gently curved toward inside with a "curve" line, so that the a feminine impression is given. In addition, the make-up to depict the brow in arch-style is furnished for a more adult image.

Request 2—The inner line is devised to be long by falling her forehairs, so that her face becomes slimmer, the lower part of the outer line is devised to be smaller to show the jaw line clearer, while the hair end is also devised to curved toward outside, which expresses herself as active. In addition, the make-up to express her brow in an ascending manner is to emphasize an image of sharpness.

Through these corrections, both hair-styles are admitted to be suitable, and thus both requests of this Model A are attained.

As explained so far, according to this invention, a hair-style is simply analyzed and the suitable hair-style is correctly and easily selected, and moreover a hair-style image map is provided so that an image of the hair-style to be selected can be obtained.

It is further understood by those skilled in the art that the foregoing description is a preferred embodiment of the disclosed matter and that various changes and modifications may be made in the invention without departing from the spirits and scope thereof.

What is claimed is:

1. A method for selecting a suitable hair-style, which comprises:

an inner line constituting a boundary line between a face and an inside of hair;

an outer line constituting an outside of the hair; and a contour of the face and an image produced by a hair-style are defined by the inner line and the outer line;

wherein an analysis is performed to determine whether the hair-style is suitable or not with regard to a formation and a balance, and another analysis is also performed to determine whether the hair-style is also suitable or not with regard to image.

2. A method according to claim 1, wherein an analysis of a formation of a hair-style and a balance is performed with five elements of balancing between upper and lower parts of a face, a silhouette, a face line, balancing between a head and the face, and total balance.

3. A method according to claim 1, wherein an analysis of an image of hair-style is performed with two elements of an impression of a hair-style and an image gap between face features and a selected hair-style.

4. A method according to claim 1, wherein for analyzing a formation of a hair-style and a balance, an analysis is performed under a comparative step adopting a standard proportion between hairs and a face.

5. A method according to claim 1, wherein a standard proportion between hair and face comprises:

a placement of eyes in a center of the hair and face;

a proportion ratio between a distance from the eye to a top end of hairs and the distance from the eye to a bottom end of a jaw is 1:1;

the proportion ratio between length of a forehead, the distance from a bottom end of the forehead to a nose tip and the distance from the nose tip to the bottom end of the jaw is 1:1:1;

the proportion ratio between the length of the forehead and the distance from the top end of the forehead where the hairs start to grow to the top end of the hairs is 1:0.5; and the proportion ratio between the length of a face and width of the face including a head and the hairs is 1.5:1.

6. A method for selecting a suitable hair-style, and conform them into with individual personalities and face contours comprising:

adopting the request of a woman for selection of hair-style;

providing an image map for hair styles where various hair styles are arranged on the axis of co-ordinates according to images;

wherein an inner line which constitutes a boundary line between a face and inside of hair and also an outer line which constitutes outside of hair are developed; and using these two lines for the selection of the suitable hair style.

* * * * *